US009011121B2

(12) United States Patent
Yokoyama et al.

(10) Patent No.: US 9,011,121 B2
(45) Date of Patent: Apr. 21, 2015

(54) REFRIGERANT COMPRESSOR AND HEAT PUMP APPARATUS

(75) Inventors: Tetsuhide Yokoyama, Tokyo (JP); Raito Kawamura, Tokyo (JP); Kei Sasaki, Tokyo (JP); Shin Sekiya, Tokyo (JP); Taro Kato, Tokyo (JP); Masao Tani, Tokyo (JP); Atsuyoshi Fukaya, Tokyo (JP); Takeshi Fushiki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 329 days.

(21) Appl. No.: 13/377,678

(22) PCT Filed: May 24, 2010

(86) PCT No.: PCT/JP2010/058721

§ 371 (c)(1),
(2), (4) Date: Dec. 12, 2011

(87) PCT Pub. No.: WO2010/143523

PCT Pub. Date: Dec. 16, 2010

(65) Prior Publication Data

US 2012/0085119 A1 Apr. 12, 2012

(30) Foreign Application Priority Data

Jun. 11, 2009 (JP) ..... 2009-139786

(51) Int. Cl.
*F01C 21/00* (2006.01)
*F04C 23/00* (2006.01)
(Continued)

(52) U.S. Cl.
CPC ..... *F04C 23/008* (2013.01); *F04C 18/3564* (2013.01); *F04C 29/0035* (2013.01);
(Continued)

(58) Field of Classification Search
USPC ..... 418/157, 273, 437, 60, 11, 63, 270; 417/312, 410.3, 902; 62/469, 498, 510, 62/506, 98, 99, 238.7, 238.6
See application file for complete search history.

(56) References Cited

U.S. PATENT DOCUMENTS 5,087,170 A * 2/1992 Kousokabe et al. ..... 415/110
5,242,280 A * 9/1993 Fujio ..... 418/11
(Continued)

FOREIGN PATENT DOCUMENTS

CN 1749572 A 3/2006
CN 1955475 A 5/2007
(Continued)

OTHER PUBLICATIONS

U.S. Appl. No. 13/377,665, filed Dec. 12, 2011, Yokoyama, et al.
(Continued)

*Primary Examiner* — Thomas Denion
*Assistant Examiner* — Thomas Olszewski
(74) *Attorney, Agent, or Firm* — Oblon, McClelland, Maier & Neustadt, L.L.P.

(57) ABSTRACT

A device that enhances compressor efficiency by reducing pressure losses in a discharge muffler space into which is discharged a refrigerant compressed by a compression unit. A low-stage discharge muffler space is formed in the shape of a ring around a drive shaft. In the low-stage discharge muffler space, a communication port flow guide is provided so as to cover a predetermined area of an opening of a communication port from a side of a flow path in a reverse direction out of two flow paths in different directions around the drive shaft from a discharge port through which is discharged the refrigerant compressed by a low-stage compression unit to the communication port through which the refrigerant flows out. The communication port flow guide transforms a direction of a flow into a direction of a connecting flow path.

16 Claims, 23 Drawing Sheets

(51) Int. Cl.

| | |
|---|---|
| ***F04C 18/356*** | (2006.01) |
| ***F04C 29/00*** | (2006.01) |
| ***F04C 29/06*** | (2006.01) |
| ***F04C 29/12*** | (2006.01) |

(52) U.S. Cl.

CPC ..... *F04C29/065* (2013.01); *F04C 29/068* (2013.01); *F04C 29/12* (2013.01); *F04C 23/001* (2013.01); *F04C 2240/30* (2013.01); *F04C 2270/12* (2013.01); *F04C 2270/13* (2013.01); *F04C 2270/14* (2013.01); *F04C 2270/20* (2013.01)

(56) References Cited

U.S. PATENT DOCUMENTS

| | | | | |
|---|---|---|---|---|
| 6,210,130 | B1 * | 4/2001 | Kakuda et al. | 417/363 |
| 6,652,238 | B2 * | 11/2003 | Kajiwara et al. | 417/44.1 |
| 6,732,542 | B2 * | 5/2004 | Yamasaki et al. | 62/278 |
| 6,807,821 | B2 * | 10/2004 | Narney, II | 62/324.6 |
| 7,611,341 | B2 * | 11/2009 | Byun et al. | 418/11 |
| 7,914,267 | B2 | 3/2011 | Sato et al. | |
| 8,342,825 | B2 * | 1/2013 | Byun et al. | 418/7 |
| 8,398,386 | B2 * | 3/2013 | Han et al. | 418/7 |
| 2003/0068236 | A1 | 4/2003 | Tadano et al. | |
| 2004/0151603 | A1 | 8/2004 | Tadano et al. | |
| 2004/0154329 | A1 | 8/2004 | Tadano et al. | |
| 2004/0165998 | A1 | 8/2004 | Tadano et al. | |
| 2004/0165999 | A1 | 8/2004 | Tadano et al. | |
| 2004/0241012 | A1 | 12/2004 | Kim et al. | |
| 2006/0056987 | A1 * | 3/2006 | Seok et al. | 417/273 |
| 2006/0168994 | A1 | 8/2006 | Tadano et al. | |
| 2008/0008608 | A1 | 1/2008 | Tadano et al. | |
| 2008/0075609 | A1 | 3/2008 | Tadano et al. | |
| 2008/0236184 | A1 | 10/2008 | Morozumi et al. | |
| 2009/0090579 | A1 | 4/2009 | Nishida et al. | |
| 2009/0180912 | A1 | 7/2009 | Morozumi et al. | |
| 2010/0111737 | A1 | 5/2010 | Higashi et al. | |
| 2010/0143172 | A1 | 6/2010 | Sato et al. | |

FOREIGN PATENT DOCUMENTS

| | | | | |
|---|---|---|---|---|
| CN | 1959116 | A | 5/2007 | |
| CN | 101153600 | A | 4/2008 | |
| JP | 58-53892 | | 4/1983 | |
| JP | 59-66662 | | 4/1984 | |
| JP | 60-171988 | | 11/1985 | |
| JP | 63-7292 | | 1/1988 | |
| JP | 63-138189 | | 6/1988 | |
| JP | 2-69091 | | 5/1990 | |
| JP | 2-294591 | | 12/1990 | |
| JP | 4-134196 | | 5/1992 | |
| JP | 4-159490 | | 6/1992 | |
| JP | 4-203488 | | 7/1992 | |
| JP | 4-342896 | | 11/1992 | |
| JP | 5-133368 | | 5/1993 | |
| JP | 5-195976 | | 8/1993 | |
| JP | 5-312166 | | 11/1993 | |
| JP | 7-208363 | | 8/1995 | |
| JP | 7-247972 | | 9/1995 | |
| JP | 11-166489 | | 6/1999 | |
| JP | 2000-9072 | | 1/2000 | |
| JP | 2000-73974 | | 3/2000 | |
| JP | 2005-509787 | | 4/2005 | |
| JP | 2007 113542 | A * | 10/2005 | F04C 18/356 |
| JP | 2006-83841 | | 3/2006 | |
| JP | 2007-113542 | | 5/2007 | |
| JP | 2007-120354 | | 5/2007 | |
| JP | 3963940 | | 6/2007 | |
| JP | 2007-178042 | | 7/2007 | |
| JP | 2007-263440 | | 10/2007 | |
| JP | 2008-38697 | | 2/2008 | |
| JP | 2008-96072 | | 4/2008 | |
| JP | 2008-248865 | | 10/2008 | |
| JP | 2008-274877 | | 11/2008 | |
| JP | 2009-2297 | | 1/2009 | |
| JP | 2009-85570 | | 4/2009 | |
| JP | 2010-48089 | | 3/2010 | |
| KR | 2003-0001175 | A | 1/2003 | |

OTHER PUBLICATIONS

U.S. Appl. No. 13/381,031, filed Dec. 27, 2011, Yokoyama, et al.
International Search Report issued Jul. 6, 2010 in patent application No. PCT/JP2010/058719.
International Search Report issued Jun. 29, 2010 in patent application No. PCT/JP2010/058720.
International Search Report issued Jun. 29, 2010 in patent application No. PCT/JP2010/058721.
The Japan Society of Fluid Mechanics, "Fluid Mechanics Handbook", May 15, 1998, pp. 437-445 (with handwritten English translation).
The Japan Society of Mechanical Engineers, "Hydraulic Losses in Pipes and Ducts", JSME Data Book, Aug. 20, 1987, pp. 76-85 (with handwritten English translation).
Takesuke Fujimoto, "Fluid Mechanics", published by Yokendo, Apr. 20, 1985, p. 136-137, 142-147 and 164-173.
Japanese Office Action Issued May 14, 2013 in Patent Application No. 2011-518394 (with English translation).
Japanese Office Action Issued May 14, 2013 in Patent Application No. 2011-518395 (with English translation).
Japanese Office Action Issued May 14, 2013 in Patent Application No. 2011-518396 (with English translation).
Extended European Search Report Issued May 10, 2013 in Patent Application No. 10786052.0.
Extended European Search Report Issued May 10, 2013 in Patent Application No. 10786054.6.
Combined Search Report and Office Action issued Dec. 4, 2013 in Chinese Patent Application No. 201080025518.0 (with English translation of Relevant portion and English Translation of Category of Cited Documents).
Office Action dated Dec. 5, 2013, issued in co-pending U.S. Appl. No. 13/377,665.
Chinese Office Action issued Jun. 30, 2014 in Chinese Application No. 201080025519.5 w/English translation.
Office Action issued Jul. 3, 2014 in Chinese Patent Application No. 201080025863.4 (with English translation).
Office Action issued Nov. 4, 2014 in Chinese Patent Application No. 201080025518.0 (with English translation).

* cited by examiner

REFRIGERANT COMPRESSOR AND HEAT PUMP APPARATUS

TECHNICAL FIELD

This invention relates to a refrigerant compressor and a heat pump apparatus using the refrigerant compressor, for example.

BACKGROUND ART

In a refrigeration air-conditioning system such as a refrigerator-freezer, an air conditioner, and a heat pump type water heater, a vapor compression type refrigeration cycle using a rotary compressor is used.

In light of preventing global warming and so on, energy-saving and efficiency-enhancing measures are needed for the vapor compression type refrigeration cycle. As a vapor compression type refrigeration cycle that aims to provide energy-saving and efficiency-enhancing measures, an injection cycle using a two-stage compressor may be pointed out. To encourage increased use of the injection cycle using the two-stage compressor, cost reduction and further enhancement of efficiency are needed.

Further, due to tightening of regulations for reducing the global warming potential (GWP) of refrigerants, consideration is being given to use of a natural refrigerant such as HC (isobutane, propane), a low-GWP refrigerant such as HFO1234fy, and so on.

However, these refrigerants operate at a lower density compared to a chlorofluorocarbon refrigerant conventionally used, so that large pressure losses occur in a compressor. Thus, there are problems when these refrigerants are used. The problems are that the efficiency of the compressor is reduced, and that the capacity of the compressor is increased.

In a prior art refrigerant compressor, when a discharge valve that controls opening/closing of a discharge port opens, a refrigerant compressed at a compression unit is discharged from a cylinder chamber of the compression unit through the discharge port into a discharge muffler space. In the discharge muffler space, pressure pulsations of the refrigerant discharged therein are reduced, and the refrigerant passes through a communication port and a communication flow path and flows into an internal space of a closed shell.

At this time, over-compression (overshoot) losses occur in the cylinder chamber due to pressure losses occurring from the time of discharge from the cylinder chamber until entry into the internal space of the closed shell, and due to pressure pulsations caused by a phase shift between change in cylinder chamber volume and opening/closing of the valve.

In a two-stage compressor, a refrigerant compressed at a low-stage compression unit is discharged into a low-stage discharge muffler space. In the low-stage discharge muffler space, pressure pulsations of the refrigerant discharged therein are reduced, and the refrigerant passes through an interconnecting flow path and flows into a high-stage compression unit. That is, the two-stage compressor is generally configured such that the low-stage compression unit and the high-stage compression unit are connected in series by an interconnecting portion such as the low-stage discharge muffler space and the interconnecting flow path.

At this time, in the prior art two-stage compressor, large intermediate pressure pulsation losses occur due to additional characteristic causes such as (1), (2) and (3) below. The intermediate pressure pulsation losses correspond to a sum of over-compression (overshoot) losses occurring in the cylinder chamber of the low-stage compression unit and under-expansion (undershoot) losses occurring at a cylinder suction portion of the high-stage compression unit.

(1) A difference in the timing of discharging the refrigerant by the low-stage compression unit and the timing of drawing in the refrigerant by the high-stage compression unit causes pressure pulsations at the interconnecting portion, thereby increasing losses due to pressure pulsations in the cylinder chamber.

(2) A difference in the timing of discharging the refrigerant by the low-stage compression unit and the timing of drawing in the refrigerant by the high-stage compression unit causes disruption to a flow of the refrigerant from a discharge port for discharging the refrigerant from the low-stage compression unit into the low-stage muffler space toward a communication port for passing the refrigerant flowing into the interconnecting flow path leading to the high-stage compression unit, thereby increasing pressure losses.

(3) Pressure losses are increased because the interconnecting flow path is narrow and long, or because a connecting port (inlet/outlet) between the interconnecting flow path and a large space causes the flow of the refrigerant to shrink or expand, or because a three-dimensional change occurs in the flow direction of the refrigerant passing through the interconnecting flow path.

Patent Document 1 discusses a two-stage compressor configured such that the volume of an interconnecting portion is greater than the excluded volume of a compression chamber of a high-stage compression unit. In this two-stage compressor, the large-volume interconnecting portion serves as a buffer, thereby reducing pressure pulsations.

Patent Document 2 discusses a two-stage compressor including an intermediate container in which an internal space is divided into two spaces by a partition member.

One of the two spaces is a main flow space which communicates from a refrigerant discharge port of a low-stage compression unit to a refrigerant suction port of a high-stage compression unit. The other space is a reverse main flow space which is not directly connected with the refrigerant discharge port of the low-stage compression unit and the refrigerant suction port of the high-stage compression unit. A refrigerant flow path is provided in the partition member dividing the main flow space and the reverse main flow space, so that the refrigerant passes between the main flow space and the reverse main flow space through the refrigerant flow path.

In this two-stage compressor, the reverse main flow space serves as a buffer container, thereby reducing pressure pulsations in the intermediate container.

Patent Document 3 discusses a two-stage compressor in which an interconnecting flow path is configured by a flow path that passes in an axial direction through a lower bearing portion, a cylinder constituting a low-stage compression unit, and an intermediate plate dividing the low-stage compression unit and a high-stage compression unit. In this two-stage compressor, the interconnecting flow path is positioned in a closed shell for downsizing.

Patent Document 4 discusses a twin rotary compressor in which two compression units connected in parallel are provided as upper and lower units. In this twin rotary compressor, a barrier portion is provided in a lower muffler space so as to form a stagnation space separated from other area by the barrier portion. In this twin rotary compressor, a refrigerant path is formed in the lower muffler space from near a discharge port toward a communication port serving as a refrigerant gas outlet to an upper side space in a closed container.

Non-Patent Document 1 discusses a bent guide flow path for reducing a fluid resistance in a bent pipeline or a bent duct, such as an elbow or a bend. In particular, it is stated at page 77 of Non-Patent Document 1 that for a bend having a rectangular cross-section, the greater the curvature of the bend, the smaller the pressure loss coefficient (pressure loss coefficient ($C_P$)=total pressure loss ($\Delta P$)÷dynamic pressure ($\rho u^2/2$)). It is also stated at page 80 of Non-Patent Document 1 that the pressure loss coefficient is reduced when a bent pipe is configured with consecutive elbows. At page 82 of Non-Patent Document 1, effects of a bend having a rectangular cross-section and including guide blades are stated. It is stated therein that an elbow bending at a right angle has a large pressure loss coefficient so that the pressure loss coefficient is reduced by providing guide blades in the bend as appropriate.

An object having a blunt side and a sharp side to a flow characteristically has greatly varying resistance coefficients depending on the orientation to the flow.

For example, Non-Patent Document 2 shows the following equation for a resistance coefficient ($C_D$) of a three-dimensional object: Resistance coefficient ($C_D$)=resistance (D)÷dynamic pressure ($\rho u^2/2$)÷projected area (S)

It is also stated in Non-Patent Document 2 that resistance coefficients vary for the same hemispherical shape. When a convex side of the hemispherical shape is directed upstream of the flow, the resistance coefficient is 0.42. On the other hand, when the convex side of the hemispherical shape is directed downstream of the flow, the resistance coefficient is 1.17, i.e., approximately tripled. When a convex side of a hemispherical shell is directed upstream of the flow, the resistance coefficient is 0.38. On the other hand, when the convex side of the hemispherical shell is directed downstream of the flow, the resistance coefficient is 1.42, i.e., approximately quadrupled. When a convex side of a two-dimensional half-cylindrical shell is directed upstream of the flow, the resistance coefficient is approximately 1.2. On the other hand, when the convex side of the two-dimensional half-cylindrical shell is directed downstream of the flow, the resistance coefficient is 2.3, i.e., approximately doubled.

Non-Patent Document 2 (p. 446) also discusses about the resistance coefficient of a two-dimensional square cylinder and how the resistance coefficient changes depending on an angle of attack ($\alpha$) to the flow. The resistance coefficient is highest at $C_D$=2.0 when the bluntest side is directed upstream of the flow ($\alpha$=0°, S=$S_0$). The resistance coefficient is $C_D$=1.5 when the sharp convex side is directed upstream of the flow ($\alpha$=45°, S=1.41$S_0$). When the angle of attack is increased in a range of 0° to 45°, the $C_D$ coefficient decreases to a minimum value of 1.25 at a limit angle ($\alpha$=13°, 1.2$S_0$) where separation occurs from the lateral side of the square. Then, the $C_D$ coefficient increases up to $C_D$=1.5. The projected area increases gradually in a range of $S_0$ to 1.41$S_0$, but the pressure resistance reaches the minimum at the limit angle ($\alpha$=13°).

Thin plates, thin airfoils, and airfoils are objects in which the resistance coefficient varies the most depending on the angle of attack ($\alpha$) to the flow.

For example, given $$\text{Resistance coefficient}(C_D)=\text{resistance}(D)\div\text{dynamic pressure}(\rho u^2/2)\div\text{airfoil surface area}(S),$$

an object of two-dimensional airfoil shape generally has the smallest resistance coefficient at near zero angle of attack ($\alpha$). The resistance coefficient remains nearly constant in a range of $-5°<\alpha<+5°$. When the angle of attack is increased further, separation occurs from the upper airfoil surface at approximately 10°, where the resistance coefficient increases sharply.

According to thin airfoil theory, such characteristics also apply to symmetric airfoils such as circular arcs or elliptical arcs.

When a resistance (D) is present in a flow path of a width y, the resistance (D) is obtained by a difference between the amounts of momentum integrated at an inlet (I) and an outlet (O) of a flow path inspection face as follows:

$$\text{Resistance}(D)=\int(p_I+\rho_I u_I^2)dy-\int(p_O+\rho_O u_O^2)dy$$

Assuming that density ($\rho$) and velocity (u) are constant at the inlet and outlet of the flow path inspection face, the resistance (D) can be expressed to be equal to an integral of a pressure loss ($\Delta P$) occurring in the flow path on the flow path width y, as shown below.

$$\text{Resistance}(D)=\int(p_I-p_O)dy=\int(\Delta P)dy$$

Conversely, the pressure loss ($\Delta P$) occurring in the flow path can be considered to be approximately proportional to the resistance (D) of an object placed in the flow path.

CITATION LIST

Patent Documents

[Patent Document 1] JP 63-138189 A
[Patent Document 2] JP 2007-120354 A
[Patent Document 3] JP 5-133368 A
[Patent Document 4] JP 2009-2297 A

Non-Patent Documents

[Non-Patent Document 1] The Japan Society of Mechanical Engineers, "Technical Data: Fluid Resistances of Pipelines and Ducts" Aug. 20, 1987, p. 77-84
[Non-Patent Document 2] The Japan Society of Fluid Mechanics, "Fluid Mechanics Handbook" May 15, 1998, p. 441-445
[Non-Patent Document 3] Takesuke Fujimoto, "Fluid Mechanics", published by Yokendo, Apr. 20, 1985, p. 136-173

DISCLOSURE OF INVENTION

Technical Problem

In the two-stage compressor discussed in Patent Document 1, an amplitude of pressure pulsations at the interconnecting portion is reduced by providing a large buffer container in the interconnecting portion.

However, when the large buffer container is provided in the interconnecting portion, expansion/shrinkage occurs in the refrigerant flowing through the interconnecting portion, so that pressure losses are increased. The flowing capability of the refrigerant flowing through the interconnecting portion is also adversely affected, thereby causing a phase lag. Thus, the amplitude of pressure pulsations at the interconnecting portion is reduced, but at the expense of increased pressure losses at the interconnecting portion.

The same situation occurs when the volume of the low-stage discharge muffler is adjusted in place of providing a buffer container. That is, when the volume of the low-stage discharge muffler space is reduced, pressure pulsations are increased and compressor efficiency is reduced. When the volume of the low-stage discharge muffler space is increased, pressure losses are increased and compressor efficiency is reduced.

In the two-stage compressor discussed in Patent Document 2, the reverse main flow space in the intermediate container serves as a single resonance space, thereby absorbing pressure pulsations occurring in the intermediate container and enhancing the compressor efficiency. In particular, this method is effective when the compressor is operating at an operating frequency that can be resonantly absorbed by the buffer container.

In actuality, however, the operating conditions of the compressor are wide-ranging, and the compressor efficiency is not enhanced at operating conditions not confirming to design criteria.

For example, suppose that the volume of the main flow space is made small and the area of the refrigerant flow path provided in the partition member is made small so as to be suitable for low-speed operating conditions with a small refrigerant discharge amount. In this case, at high-speed operating conditions with a large refrigerant discharge amount, pressure pulsations and pressure losses are increased. Thus, the compressor efficiency is not necessarily enhanced.

In the two-stage compressor discussed in Patent Document 3, pressure losses in the interconnecting portion characteristically occurring in the two-stage compressor are reduced by forming the interconnecting flow path in the compression mechanism, thereby shortening the length of the interconnecting flow path. By providing the interconnecting flow path not external to the closed shell, downsizing can also be achieved.

However, the interconnecting flow path includes sharp bends. Thus, the flow of the refrigerant is expanded or shrunk and the direction of the flow is turned at connection portions of respective components of the interconnecting portion, thereby increasing pressure losses and causing the compressor efficiency to be reduced.

In the twin rotary compressor discussed in Patent Document 4, pressure losses are reduced by configuring in the muffler space the flow path from the discharge port to the communication port by using an end plate member. However, the volume of the flow path into which the compressed refrigerant gas is discharged is smaller than the volume of the muffler space, so that pressure pulsations are increased and the compressor efficiency is adversely affected.

It is an object of this invention to enhance the compressor efficiency by reducing pressure losses in a discharge muffler space into which is discharged a refrigerant compressed at a compression unit.

Solution to Problem

A refrigerant compressor according to this invention is configured by stacking a plurality of compression units and an intermediate partition plate in a direction of a drive shaft, the plurality of compression units being driven by rotation of the drive shaft passing through a center portion, each of the plurality of compression units drawing a refrigerant into a cylinder chamber and compressing the refrigerant in the cylinder chamber, and the intermediate partition plate being positioned between the cylinder chamber of one of the plurality of compression units and the cylinder chamber of another one of the plurality of compression units.

The refrigerant compressor includes a discharge muffler that defines, as a ring-shaped space around the drive shaft, a discharge muffler space including a discharge port through which the refrigerant compressed at a predetermined compression unit of the plurality of compression units is discharged from the cylinder chamber of that compression unit, and a communication port through which the refrigerant discharged through the discharge port flows out to a different space, a connecting flow path that passes through the intermediate partition plate in the direction of the drive shaft, and guides the refrigerant from the discharge muffler space through the communication port to the different space, and a communication port flow guide that covers a predetermined area of an opening portion of the communication port in the discharge muffler space.

Advantageous Effects of Invention

A multi-stage compressor according to this invention circulates a flow from a discharge port to a communication port in a fixed direction around a shift in a ring-shaped discharge muffler space, and includes a communication port flow guide for smoothly transforming a direction of the flow at the communication port into an axial direction in which an interconnecting flow path passes through. Thus, not only pressure pulsations and pressure losses occurring in the discharge muffler space but also pressure losses occurring near the communication port can be reduced, so that compressor efficiency can be enhanced.

DESCRIPTION OF EMBODIMENTS

First Embodiment

The following description concerns a two-stage compressor (two-stage rotary compressor) having two compression units (compression mechanisms), namely a low-stage compression unit and a high-stage compression unit, as an example of a multi-stage compressor. The multi-stage compressor may have three or more compression units (compressor mechanisms).

In the following drawings, an arrow indicates a flow of a refrigerant.

Figure 1:
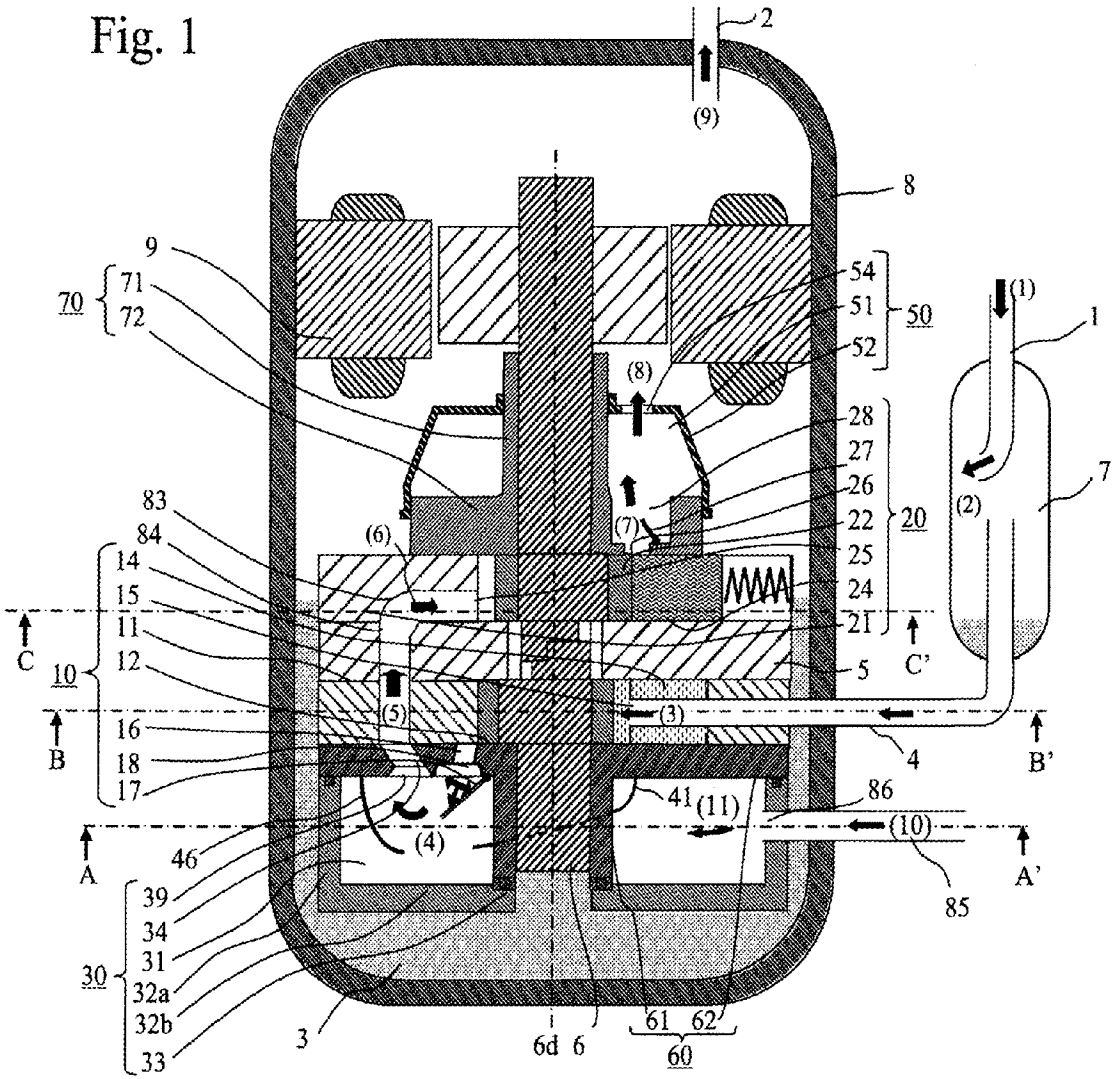
FIG. 1 is a cross-sectional view of an overall configuration of a two-stage compressor according to a first embodiment.

FIG. 1 is a cross-sectional view of an overall configuration of a two-stage compressor according to a first embodiment.

Figure 2:
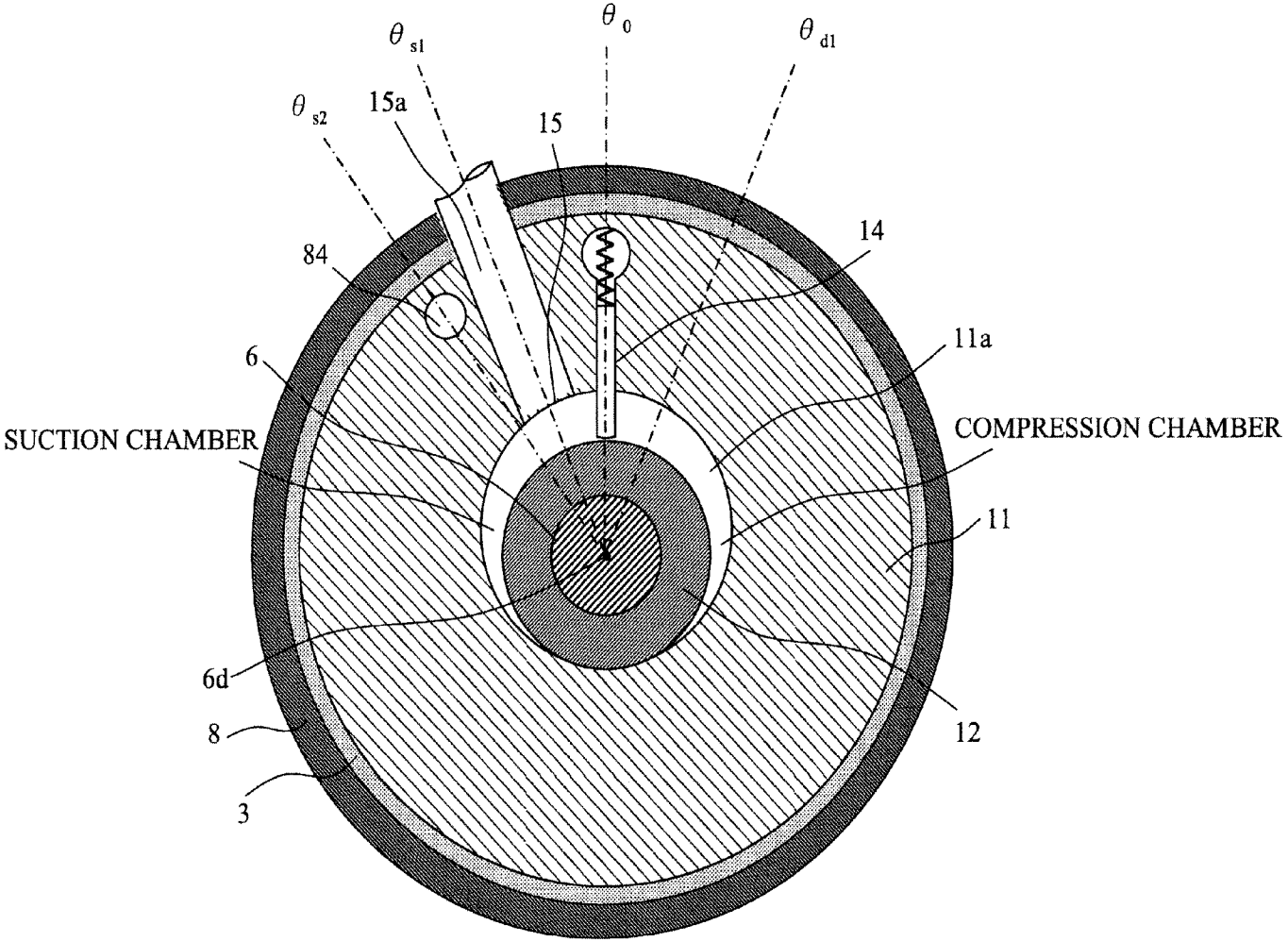
FIG. 2 is a cross-sectional view of the two-stage compressor according to the first embodiment taken along line B-B' of FIG. 1.

FIG. 2 is a cross-sectional view of the two-stage compressor according to the first embodiment taken along line B-B' of FIG. 1.

Figure 3:
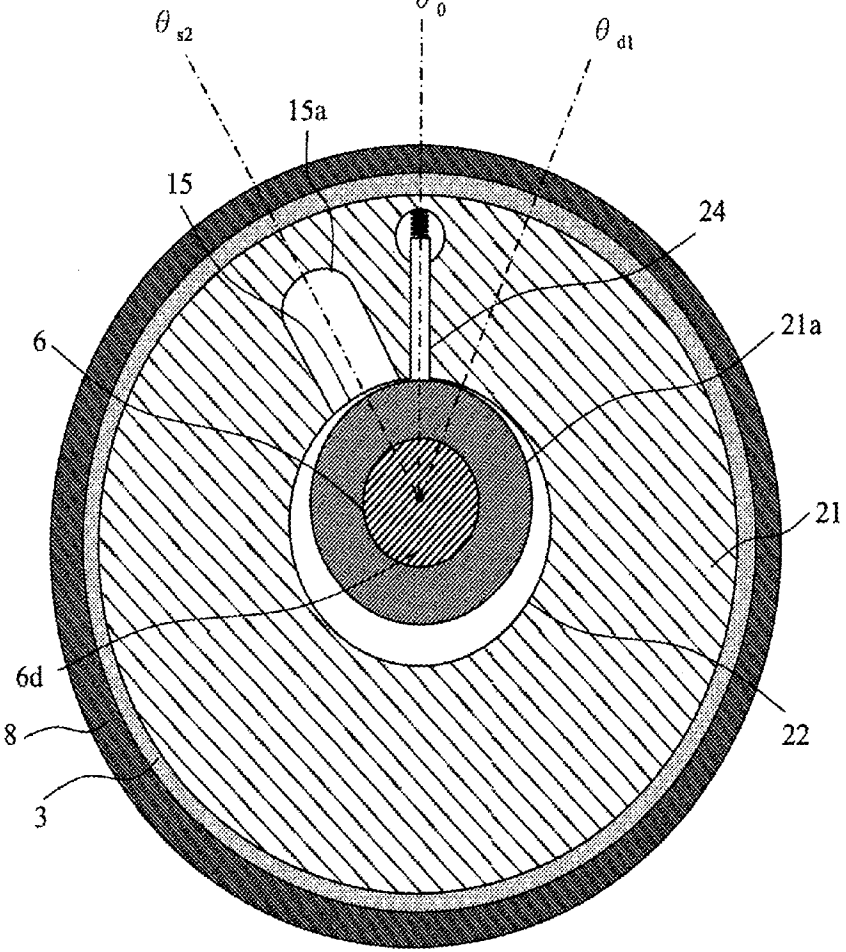
FIG. 3 is a cross-sectional view of the two-stage compressor according to the first embodiment taken along line C-C' of FIG. 1.

FIG. 3 is a cross-sectional view of the two-stage compressor according to the first embodiment taken along line C-C' of FIG. 1.

The two-stage compressor according to the first embodiment includes, in a closed shell 8, a low-stage compression unit 10, a high-stage compression unit 20, a low-stage discharge muffler 30, a high-stage discharge muffler 50, a lower support member 60, an upper support member 70, a lubricating oil storage unit 3, an intermediate partition plate 5, a drive shaft 6, and a motor unit 9.

The low-stage discharge muffler 30, the lower support member 60, the low-stage compression unit 10, the intermediate partition plate 5, the high-stage compression unit 20, the upper support member 70, the high-stage discharge muffler 50, and the motor unit 9 are stacked in order from a lower side in an axial direction of the drive shaft 6. In the closed shell 8, the lubricating oil storage unit 3 for a lubricating oil that lubricates a compression mechanism is provided at the bottom in the axial direction of the drive shaft 6.

The low-stage compression unit 10 and the high-stage compression unit 20 include cylinders 11 and 21 configured with parallel flat plates, respectively. In the cylinders 11 and 21, cylindrically-shaped cylinder chambers 11*a* and 21*a* (compression spaces, see FIGS. 2 and 3) are formed, respectively. In the cylinder chambers 11*a* and 21*a*, rolling pistons 12 and 22 and vanes 14 and 24 are provided, respectively. In the cylinders 11 and 21, cylinder suction flow paths 15*a* and 25*a* (see FIGS. 2 and 3) communicating with the cylinder chambers 11*a* and 21*a* through cylinder suction ports 15 and 25 are provided, respectively.

The low-stage compression unit 10 is stacked such that the cylinder 11 is positioned between the lower support member 60 and the intermediate partition plate 5.

The high-stage compression unit 20 is stacked such that the cylinder 21 is positioned between the upper support member 70 and the intermediate partition plate 5.

The low-stage discharge muffler 30 includes a low-stage discharge muffler sealing portion 33 and a container having a container outer wall 32*a* and a container bottom lid 32*b*.

The low-stage discharge muffler 30 defines a low-stage discharge muffler space 31 enclosed by the container having the container wall 32*a* and the lower support member 60. A clearance between the container having the container wall 32*a* and the lower support member 60 is sealed by the low-stage discharge muffler sealing portion 33 so as to prevent leakage of a refrigerant at an intermediate pressure that has entered the low-stage discharge muffler space 31. The low-stage discharge muffler space 31 is provided with a communication port 34 that communicates with the high-stage compression unit 20 through an interconnecting flow path 84 (connecting flow path). The communication port 34 is provided in a discharge-port-side wall 62 of the lower support member 60.

The high-stage discharge muffler 50 includes a container 52 having a container outer wall and a container bottom lid.

The high-stage discharge muffler 50 defines a high-stage discharge muffler space 51 enclosed by the container 52 and the upper support member 70. The container 52 is provided with a communication port 54 through which the refrigerant flows out to a motor in an internal space of the closed shell 8.

The lower support member 60 includes a lower bearing portion 61 and the discharge-port-side wall 62.

The lower bearing portion 61 is cylindrically-shaped and supports the drive shaft 6. The discharge-port-side wall 62 defines the low-stage discharge muffler space 31 and supports the low-stage compression unit 10.

The discharge-port-side wall 62 has formed therein a discharge valve accommodating recessed portion 18 (valve accommodating slot) where a discharge port 16 is provided. The discharge port 16 communicates the cylinder chamber 11*a* defined by the cylinder 11 of the low-stage compression unit 10 with the low-stage discharge muffler space 31 defined by the low-stage discharge muffler 30. The discharge valve accommodating recessed portion 18 is a slot formed around the discharge port 16. A discharge valve 17 (on/off valve) that opens and closes the discharge port 16 is attached to the discharge valve accommodating recessed portion 18.

Likewise, the upper support member 70 includes an upper bearing portion 71 and a discharge-port-side wall 72.

The upper bearing portion 71 is cylindrically-shaped and supports the drive shaft 6. The discharge-port-side wall 72 defines the high-stage discharge muffler space 51 and supports the high-stage compression unit 20.

The discharge-port-side wall 72 has formed therein a discharge valve accommodating recessed portion 28 where a discharge port 26 is provided. The discharge port 26 communicates the cylinder chamber 21*a* defined by the cylinder 21 of the high-stage compression unit 20 with the high-stage discharge muffler space 51 defined by the high-stage discharge muffler 50. The discharge valve accommodating recessed portion 28 is a slot formed around the discharge port 26. A discharge valve 27 (on/off valve) that opens and closes the discharge port 26 is attached to the discharge valve accommodating recessed portion 28.

The interconnecting flow path 84 is formed in the closed shell 8. The interconnecting flow path 84 connects the communication port 34 and the cylinder suction flow path 25*a* of the high-stage compression unit 20 by passing through the lower support member 60, the cylinder 11 of the low-stage compression unit 10, and the intermediate partition plate 5.

As shown in FIGS. 2 and 3, a phase $\theta_{s1}$ at which the cylinder suction port 15 of the low-stage compression unit 10 is provided is shifted from a phase $\theta_{s2}$ at which the cylinder suction port 25 of the high-stage compression unit 20 is provided. The communication port 34 is a round hole formed in the discharge-port-side wall 62 of the lower support member 60. The communication port 34 is positioned at the phase $\theta_{s2}$ (see FIG. 4). That is, the communication port 34 is positioned so as to overlap in the axial direction with the cylinder suction flow path 25*a* extending in a radial direction from the cylinder suction port 25 positioned at the phase $\theta_{s2}$. The interconnecting flow path 84 is defined from the lower side in the axial direction by round holes formed in the discharge-port-side wall 62 of the lower support member 60, the cylinder 11 of the low-stage compression unit 10, and the intermediate partition plate 5. The interconnecting flow path 84 is defined as a rectilinear path in a substantially parallel relation with the drive shaft 6. The interconnecting flow path 84 is slightly inclined away from the discharge port 16 at the discharge-port-side wall 62.

In the low-stage discharge muffler space 31, a guide slot 39 connected with the discharge valve accommodating recessed portion 18 is provided around the communication port 34.

The two-stage compressor according to the first embodiment includes, external to the closed shell 8, a compressor suction pipe 1, a suction muffler connecting pipe 4, and a suction muffler 7. The suction muffler 7 draws in a refrigerant from an external refrigerant circuit through the compressor suction pipe 1. The suction muffler 7 then separates the refrigerant into a gas refrigerant and a liquid refrigerant. The separated gas refrigerant is drawn into the cylinder chamber 11*a* of the low-stage compression unit 10 through the suction muffler connecting pipe 4.

A flow of the refrigerant in the two-stage compressor will be described.

First the refrigerant at a low pressure passes through the compressor suction pipe 1 ((1) of FIG. 1) and flows into the suction muffler 7 ((2) of FIG. 1). The refrigerant that has flowed into the suction muffler 7 is separated into the gas refrigerant and the liquid refrigerant. After being separated into the gas refrigerant and the liquid refrigerant, the gas refrigerant passes through the suction muffler connecting pipe 4 and is drawn into the cylinder chamber 11*a* of the low-stage compression unit 10 ((3) of FIG. 1).

The refrigerant drawn into the cylinder chamber 11*a* is compressed to an intermediate pressure at the low-stage compression unit 10. The refrigerant compressed to the intermediate pressure is discharged into the low-stage discharge muffler space 31 from the discharge port 16 ((4) of FIG. 1). The discharged refrigerant passes through the communication port 34 and the interconnecting flow path 84 ((5) of FIG. 1), and is drawn into the cylinder chamber 21*a* of the high-stage compression unit 20 ((6) of FIG. 1).

The refrigerant drawn into the cylinder chamber 21*a* is compressed to a high pressure at the high-stage compression unit 20. The refrigerant compressed to the high pressure is discharged into the high-stage discharge muffler space 51 from the discharge port 26 ((7) of FIG. 1). Then, the refrigerant discharged into the high-stage discharge muffler space 51 is discharged into the closed shell 8 from the communication port 54 ((8) of FIG. 1). The refrigerant discharged into the closed shell 8 passes through a clearance in the motor unit 9 at an upper side of the compression unit, then passes through a compressor discharge pipe 2 fixed to the closed shell 8, and is discharged to the external refrigerant circuit ((9) of FIG. 1).

During an injection operation, an injection refrigerant flowing through an injection pipe 85 ((10) of FIG. 1) is injected into the low-stage discharge muffler space 31 from an injection port 86 ((11) of FIG. 1). Then, in the low-stage discharge muffler space 31, the injection refrigerant ((11) of FIG. 1) is mixed with the refrigerant discharged into the low-stage discharge muffler space 31 from the discharge port 16 ((4) of FIG. 1). The mixed refrigerant is drawn into the cylinder 21 of the high-stage compression unit 20 ((5) (6) of FIG. 1), and is compressed to a high pressure and discharged outwardly ((7) (8) (9) of FIG. 1), as described above.

When the refrigerant at the high pressure passes through the closed shell 8, the refrigerant and lubricating oil are separated. The separated lubricating oil is stored in the lubricating oil storage unit 3 at the bottom of the closed shell 8, and is picked up by a rotary pump attached to a lower portion of the drive shaft 6 so as to be supplied to a sliding portion and a sealing portion of each compression unit.

As described above, the refrigerant compressed to the high pressure at the high-stage compression unit 20 and discharged into the high-stage discharge muffler space 51 is discharged into the closed shell 8. Thus, the closed shell 8 has an internal pressure equal to a discharge pressure of the high-stage compression unit 20. Hence, the two-stage compressor shown in FIG. 1 is of a high-pressure shell type.

Compression operations of the low-stage compression unit 10 and the high-stage compression unit 20 will be described.

The low-stage compression unit 10 and the high-stage compression unit 20 are configured with parallel flat-plate cylinders stacked in the axial direction of the drive shaft 6. In the low-stage compression unit 10 and the high-stage compression unit 20, the cylinder chambers 11*a* and 21*a* being cylindrically-shaped are partitioned into a compression chamber and a suction chamber by the vanes 14 and 24, respectively (see FIGS. 2 and 3). In the low-stage compression unit 10 and the high-stage compression unit 20, rotation of the drive shaft 6 causes the rolling pistons 11 and 22 to eccentrically rotate, thereby changing the volume of the compression chamber and the volume of the suction chamber. By using this change in the volume of the compression chamber and the volume of the suction chamber, the low-stage compression unit 10 and the high-stage compression unit 20 compress the refrigerant drawn in from the cylinder suction ports 15 and 25, and discharge the compressed refrigerant from the discharge ports 16 and 26 of respective cylinders. That is, the two-stage compressor is a rotary compressor.

Specifically, the motor unit 9 rotates the drive shaft 6 on an axis 6*d*, thereby driving the compression units 10 and 20. In the low-stage compression unit 10 and the high-stage compression unit 20 respectively, rotation of the drive shaft 6 causes the rolling pistons 11 and 12 in the cylinder chambers 11*a* and 21*a* to eccentrically rotate counterclockwise with a phase shift of 180 degrees with respect to each other.

In the low-stage compression unit 10, the rolling piston 12 compresses the refrigerant by rotating such that an eccentric position to minimize a clearance between the rolling piston 12 and the inner wall of the cylinder 11 moves, in order, from a rotation reference phase $\theta_0$ (see FIG. 2) through a phase $\theta_{s1}$ at the cylinder suction port (see FIG. 2) to a phase $\theta_{d1}$ at the low-stage discharge port (see FIG. 2). The rotation reference phase is defined as the position of the vane 14 that partitions the cylinder chamber 11*a* into the compression chamber and the suction chamber. That is, the rolling piston 12 compresses the refrigerant by rotating counterclockwise from the rotation reference phase through the phase at the cylinder suction port 15 to the phase at the discharge port 16.

Likewise, in the high-stage compression unit 20, the rolling piston 22 compresses the refrigerant by rotating counterclockwise from the rotation reference phase $\theta_0$ through a phase $\theta_{s2}$ at the cylinder suction port 25 (see FIG. 3) to a phase $\theta_{d2}$ at the discharge port 26 (see FIG. 3).

The low-stage discharge muffler space 31 will be described.

Figure 4:
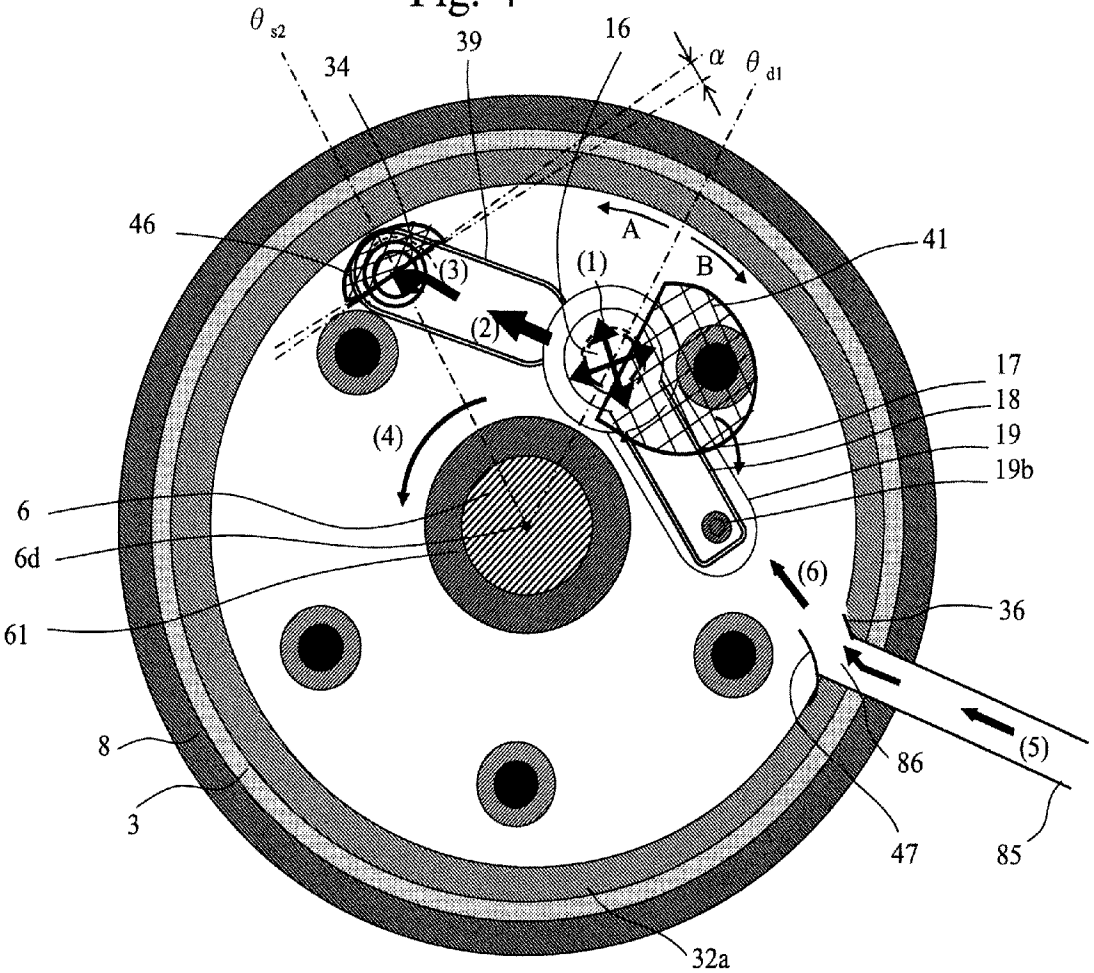
FIG. 4 is a cross-sectional view of the two-stage compressor according to the first embodiment taken along line A-A' of FIG. 1.

FIG. 4 is a cross-sectional view of the two-stage compressor according to the first embodiment taken along line A-A' of FIG. 1.

As shown in FIG. 4, the low-stage discharge muffler space 31 is formed in the shape of a ring (doughnut), such that an inner peripheral wall is defined by the lower bearing portion 61 and an outer peripheral wall is defined by the container outer wall 32*a* at a cross-section perpendicular to the axial direction of the drive shaft 6. That is, the low-stage discharge muffler space 31 is formed in the shape of a ring (loop).

Thus, there are two flow paths from the discharge port 16 to the communication port 34, namely a flow path in a forward direction (direction A of FIG. 4) and a flow path in a reverse direction (direction B of FIG. 4). Likewise, there are two flow paths from the injection port 86 to the communication port 34, namely a flow path in the forward direction (direction A of FIG. 4) and a flow path in the reverse direction (direction B of FIG. 4).

The refrigerant compressed at the low-stage compression unit 10 is discharged from the discharge port 16 into the low-stage discharge muffler space 31 ((1) of FIG. 4). The injection refrigerant is also injected from the injection port 86 into the low-stage discharge muffler space ((6) of FIG. 4). These refrigerants (i) circulate in the forward direction (direction A of FIG. 4) in the ring-shaped low-stage discharge muffler space 31 ((4) of FIG. 1), and (ii) pass through the communication port 34 and the interconnecting flow path 84 and flow into the high-stage compression unit 20 ((3) of FIG. 4).

The refrigerant entering the low-stage discharge muffler space 31 flows like (i) and (ii) above because an operation of the high-stage compression unit 20 generates a force to draw the refrigerant into the communication port 34, and because a discharge port rear guide 41 and an injection port guide 47 are provided in the low-stage discharge muffler space 31.

Figure 5:
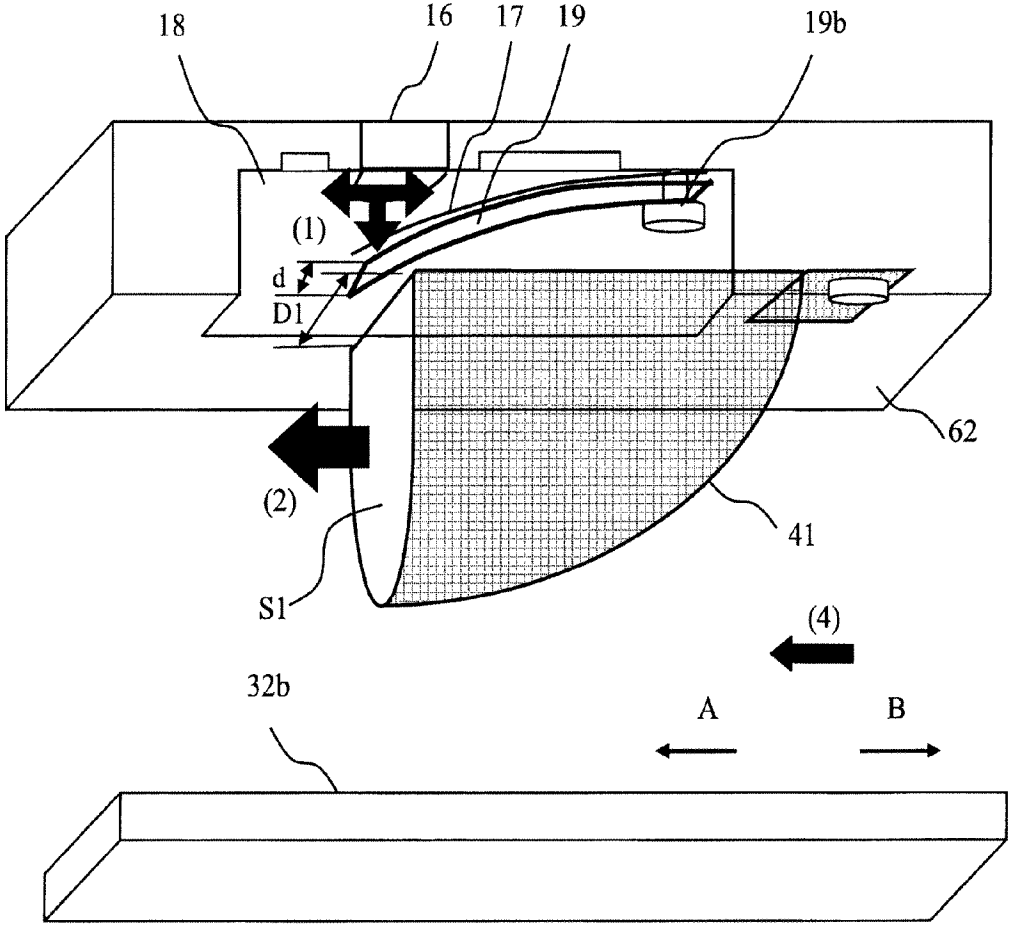
FIG. 5 is a diagram illustrating a discharge port rear guide 41 according to the first embodiment.

Referring to FIGS. 4 and 5, the discharge port rear guide 41 will be described.

FIG. 5 is a diagram illustrating the discharge port rear guide 41 according to the first embodiment.

The discharge port rear guide 41 is provided in the proximity of the discharge port 16, so as to form a smooth curve from a side of the flow path in the reverse direction from the discharge port 16 to the communication port 34 in the ring-shaped discharge muffler space, such that the discharge port rear guide 41 covers a predetermined area extending from an opening of the discharge port 16 to an edge portion of the opening. Hereinafter, a side of the discharge port 16 facing the flow path in the reverse direction will be called a reverse side of the discharge port 16, and a side of the discharge port 16 facing the flow path in the forward direction will be called a communication port 34 side of the discharge port 16. The length of the flow path from the discharge port 16 to the communication port 34 is longer in the reverse direction than in the forward direction. The discharge port rear guide 41 has an opening directed to the communication port 34 side and interposed from the discharge-port-side wall 62.

It is desirable that the discharge port rear guide 41 prevent the refrigerant discharged from the discharge port 16 from flowing in the reverse direction, and not prevent a flow of the refrigerant from circulating in the forward direction. Therefore, the discharge port rear guide 41 is formed in a concave shape at the side of the discharge port 16 (forward direction side) and in a convex shape at the side opposite from the discharge port 16 (reverse direction side). For example, the discharge port rear guide 41 is formed such that a cross-sectional surface thereof perpendicular to the axial direction is U-shaped or V-shaped with the side of the discharge port 16 in a concave shape and the opposite side in a convex shape.

As a material for forming the discharge port rear guide 41, it is desirable to use a metal plate with a large number of perforations, such as perforated metal or metallic mesh, for example. By using a metal plate with a large number of perforations as a material for forming the discharge port rear guide 41, pressure pulsations of the refrigerant discharged form the discharge port 16 can be reduced. Another advantageous effect is that the refrigerant discharged from the discharge port 16 can be mixed and guided with the refrigerant circulating in the low-stage discharge muffler space 31.

As shown in FIG. 5, the discharge-port-side wall 62 of the lower support member 60 has formed therein the discharge valve accommodating recessed portion 18 where the discharge port 16 is provided. The discharge valve 17 formed by a thin plate-like elastic body such as a plate spring is attached to the discharge valve accommodating recessed portion 18. A stopper 19 for adjusting (limiting) a lift amount (bending degree) of the discharge valve 17 is attached so as to cover the discharge valve 17. The discharge valve 17 and the stopper 19 are fixed at one end to the discharge valve accommodating recessed portion 18 with a bolt 19*b*.

A difference between the pressure in the cylinder chamber 11*a* formed in the cylinder 11 of the low-stage compression unit 10 and the pressure in the low-stage discharge muffler space 31 causes the discharge valve 17 to be lifted, thereby opening and closing the discharge port 16. The refrigerant is thus discharged from the discharge port 16 into the low-stage discharge muffler space 31. That is, a discharge valve mechanism for opening the discharge port 16 is of a reed valve type.

As shown in FIG. 5, the stopper 19 is fixed at one end to the rear side of the discharge port 16, and is formed to be gradually inclined away from the discharge port 16 toward the communication port 34 side of the discharge port 16. However, the stopper 19 has a narrow radial width d, and is inclined at a gentle angle nearly parallel to the discharge-port-side wall 62 where the discharge port 16 is formed. Therefore, the stopper 19 provides little interference with a flow in the reverse direction (direction B of FIGS. 4 and 5) of the refrigerant discharged from the discharge port 16.

In contrast, the discharge port rear guide 41 is provided so as to cover not only the discharge port 16 but also the discharge valve 17 and the stopper 19 from the rear side of the discharge port 16. That is, a radial width D1 of the discharge port rear guide 41 is greater than a diameter of the discharge port 16, a radial width of the discharge valve 17, and the radial width d of the stopper 19. A projected flow path area S1 of the discharge port rear guide 41 is greater than a projected flow path area s (=d×height h) of the stopper 19. Thus, the discharge port rear guide 41 can prevent the refrigerant discharged from the discharge port 16 from flowing in the reverse direction, to a wider extent compared to the stopper 19. The projected flow path area S1 of the discharge port rear guide 41 is an area of a figure obtained by rotating the discharge port rear guide 41 with the axis 6*d* as a rotational axis and plotting a trajectory of the discharge port rear guide 41 on a predetermined flat surface across the axis 6*d*. Likewise, the projected flow path area s of the stopper is an area of a figure obtained by rotating the stopper 19 with the axis 6*d* as a rotational axis and plotting a trajectory of the stopper 19 on the predetermined flat surface across the axis 6*d*.

The discharge port rear guide 41 is disposed such that the concave side is directed upstream of the flow in the reverse direction, and the convex side is directed downstream of the flow in the forward direction. As a result, a resistance coefficient occurring at the discharge port rear guide is greater in the flow in the reverse direction than in the flow in the forward direction. For example, in the case of a hemispherical shell, the resistance coefficient occurring at the discharge port rear guide is greater by approximately five times. Thus, by providing the discharge port rear guide 41, the refrigerant discharged from the discharge port 16 can be circulated in the forward direction.

Referring to FIG. 4, the injection port guide 47 will be described.

The injection port guide 47 is provided in the proximity of the injection port 86 at the side of the flow path in the reverse direction from the injection port 86 to the communication port 34. In particular, the injection port guide 47 is provided so as to incline and cover the injection port 86 from the side of the flow path in the reverse direction, and to protrude into the low-stage discharge muffler space 31.

When the refrigerant that has flowed through the injection pipe 85 ((5) of FIG. 4) is injected from the injection port 86, the refrigerant is guided by the injection port guide 47 to flow in the forward direction ((6) of FIG. 4). Then, the injection refrigerant circulates in the forward direction. A wall at the forward direction side of the injection port 86 is tapered to be approximately parallel to the injection port guide 47.

Thus, because of the force to draw the refrigerant into the communication port 34 and because of the discharge port rear guide 41 preventing a flow in the reverse direction, the refrigerant discharged radially into the low-stage discharge muffler space 31 ((1) of FIG. 4) flows in the forward direction (direction A of FIG. 4) ((2) of FIG. 4). The refrigerant that has flowed in the forward direction from the discharge port 16 passes through the communication port 34 and the interconnecting flow path 84, and flows into the cylinder chamber 21*a* of the high-stage compression unit 20 ((3) of FIG. 4). Because of a lag between the timing of discharging the refrigerant by the low-stage compression unit 10 and the timing of drawing in the refrigerant by the high-stage compression unit 20 and so on, some of the refrigerant does not flow into the communication port 34. The refrigerant that has flowed in the forward direction from the discharge port 16 and has not flowed into the communication port 34 continues to flow in the forward direction and circulates in the ring-shaped low-stage discharge muffler space 31 ((4) of FIG. 4).

The refrigerant injected from the injection port 86 ((5) of FIG. 4) is guided by the injection port guide 47 to flow in the forward direction ((6) of FIG. 4). Then, the refrigerant is joined and mixed with the refrigerant circulating in the ring-shaped low-stage discharge muffler space 31, and flows in the low-stage discharge muffler space 31. Some of the refrigerant flowing in the low-stage discharge muffler space 31 passes through the communication port 34 and the interconnecting flow path 84, and flows into the cylinder chamber 21*a* of the high-stage compression unit 20 ((3)) of FIG. 4). The remaining refrigerant circulates in the ring-shaped low-stage discharge muffler space 31 ((4) of FIG. 4).

As described above, the communication port 34 is provided in the discharge-port-side wall 62 of the lower support member 60. Thus, when the refrigerant flowing in the forward direction from the discharge port 16 in a substantially horizontal direction (lateral direction of FIG. 1) passes through the communication port 34 and flows into the interconnecting flow path 84, the direction of the flow is transformed into an axial upward direction (upward direction of FIG. 1). That is, when the refrigerant flows through the communication port 34 into the interconnecting flow path 84, the flow of the refrigerant is deflected approximately 90 degrees.

In the interconnecting flow path 84, the flow of the refrigerant in the axial upward direction (upward direction of FIG. 1) is turned to the substantially parallel direction (lateral direction of FIG. 1) at a bend portion 83 (see FIG. 1) of the interconnecting flow path 84. The refrigerant then flows into the cylinder chamber 21*a* of the high-stage compression unit 20. That is, the flow of the refrigerant is deflected approximately 90 degrees again, and the refrigerant flows into the cylinder chamber 21*a*.

When sudden changes occur in the flow direction of the refrigerant as described above, pressure losses occur.

As shown in FIG. 4, a communication port flow guide 46 is provided in the proximity of the communication port 34 in the low-stage discharge muffler space 31. The guide slot 39 is also formed around the communication port 34. One end of the guide slot 39 is connected with the discharge valve accommodating recessed portion 18.

The communication port flow guide 46 will be described.

Figure 6:
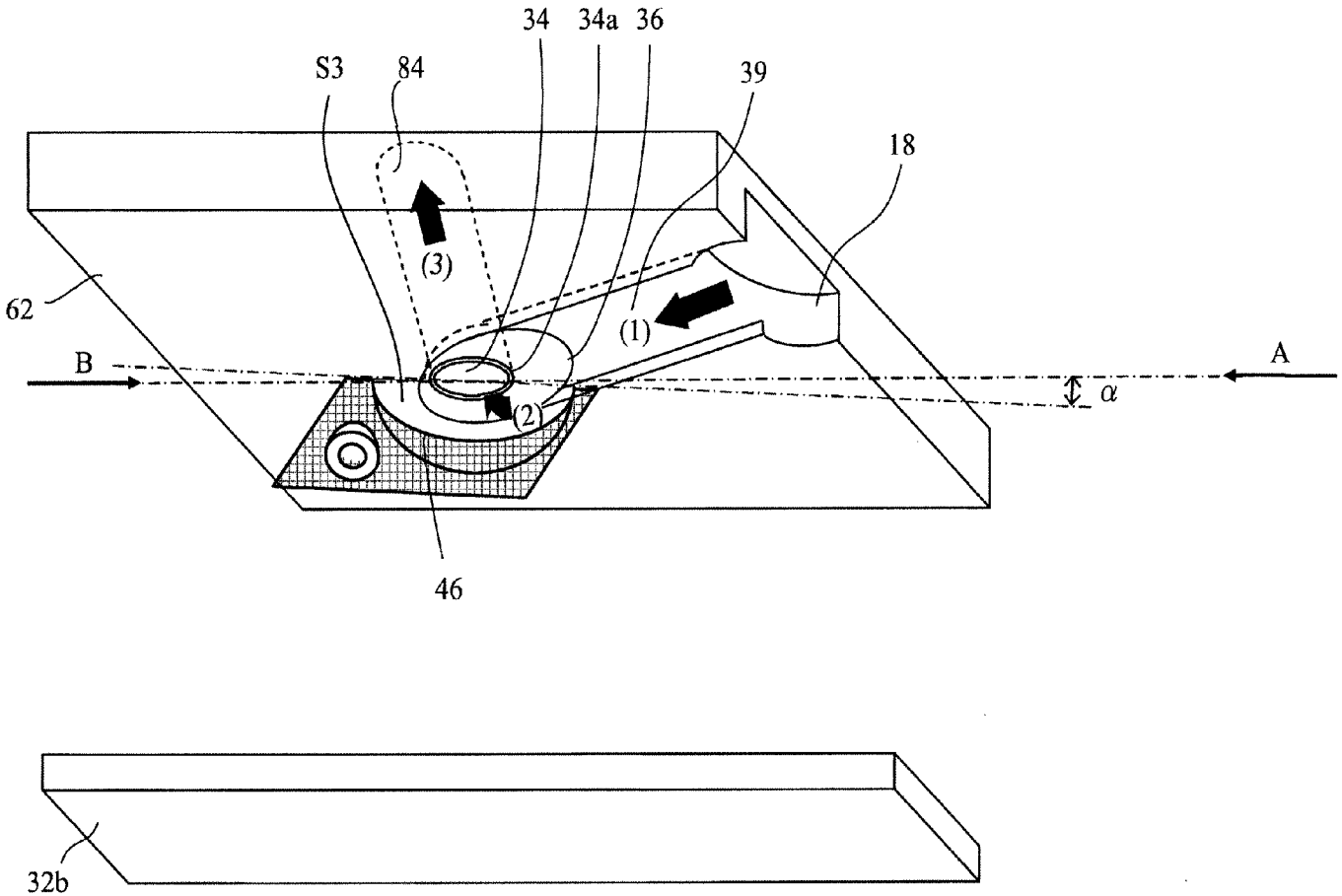
FIG. 6 is a diagram illustrating a communication port flow guide 46 according to the first embodiment.

FIG. 6 is a diagram illustrating the communication port flow guide 46 according to the first embodiment. In FIG. 6, a component that is actually invisible is indicated by dashed lines.

The communication port flow guide 46 is attached to the discharge-port-side wall 62 of the lower support member 60 so as to form a smooth circular curve covering a predetermined area extending to the edge portion of the opening of the communication port 34. Further, the communication port flow guide 46 is formed so as to incline toward the low-stage discharge muffler space 31 and cover the opening of the communication port 34 from underneath. When viewed from underneath as shown in FIG. 4, the communication port flow guide 46 has an opening face connected with the communication port and a circularly curved face blocking a flow.

Let an angle $\alpha$ be an angle at which the opening face of the communication port flow guide 46 is positioned relative to the flow from the discharge port 16 to the communication port 34 in the forward direction (direction A of FIGS. 4 and 6) around the axis of the drive shaft 6. It is arranged that $\alpha$ is within 15 degrees, i.e., small enough to be nearly parallel.

As discussed in Non-Patent Document 3, for an object of substantially airfoil shape, the smallest resistance coefficient is obtained when $\alpha$ is sufficiently small. In the case of a semicircular arc, a projected rotation area of the flow in the forward direction (direction A of FIGS. 4 and 6) becomes smaller in proportion with $\alpha$, so that the resistance occurring at the communication port flow guide 46 also decreases. That is, pressure losses occurring in the circulation flow path in the forward direction are small.

The communication port flow guide 46 has formed therein an opening facing the axis 6*d* and interposed from the discharge-port-side wall 62 where the communication port 34 is formed. An open area S3 of this opening is greater than an open area of the communication port 34 and a flow path area of the interconnecting flow path 84. The communication port flow guide 46 forms a gentle curve covering the opening of the communication port 34 from a side far from the axis (outer side) toward the axis 6*d*, so that a horizontal flow of the refrigerant from the discharge port 16 to the communication port 34 can be smoothly transformed into an upward flow. In addition, the opening larger than the communication port 34 is provided between the communication port flow guide 46 and the discharge-port-side wall 62, so that the communication port flow guide 46 can guide the refrigerant toward the communication port 34.

The guide slot 39 will be described.

The guide slot 39 is a slot formed around the communication port 34. One end of the guide slot 39 is connected to a slot of the discharge valve accommodating recessed portion 18. When the refrigerant discharged from the discharge port 16 is drawn by a force drawing toward the communication port 34, the refrigerant flows along the guide slot 39. That is, the refrigerant discharged from the discharge port 16 is guided to the communication port 34 by the guide slot 39. Thus, the refrigerant discharged from the discharge port 16 is facilitated to flow into the communication port 34.

The opening of the communication port 34 has a chamfered edge 34*a* and a tapered portion 36 spreading toward the low-stage discharge muffler space 31. That is, the communication port 34 is formed so as to flare out toward the low-stage discharge muffler space 31. Thus, the refrigerant discharged from the discharge port 16 is facilitated to flow into the communication port 34. The tapered portion 36 also allows the horizontal flow of the refrigerant from the discharge port 16 to the communication port 34 to be smoothly transformed into an upward flow.

The interconnecting flow path 84 formed in the discharge-port-side wall 62 is slightly inclined away from the discharge port 16. That is, the interconnecting flow path 84 formed in the discharge-port-side wall 62 is slightly inclined toward the rear side of the communication port 34 (the reverse flow path side of the communication port 34). This prevents the horizontal flow of the refrigerant from the discharge port 16 to the communication port 34 from being suddenly transformed into an upward flow. As a result, the horizontal flow can be smoothly transformed into the upward flow.

As a material for forming the communication port flow guide 46, it is desirable to use a metal plate with a large number of perforations such as perforated metal or metallic mesh, for example. By using a metal plate with a large number of perforations as a material for forming the communication port flow guide 46, pressure pulsations of the refrigerant discharged from the discharge port 16 can be reduced.

The cylinder suction flow path 25*a* of the high-stage compression unit 20 will be described.

Figure 7:
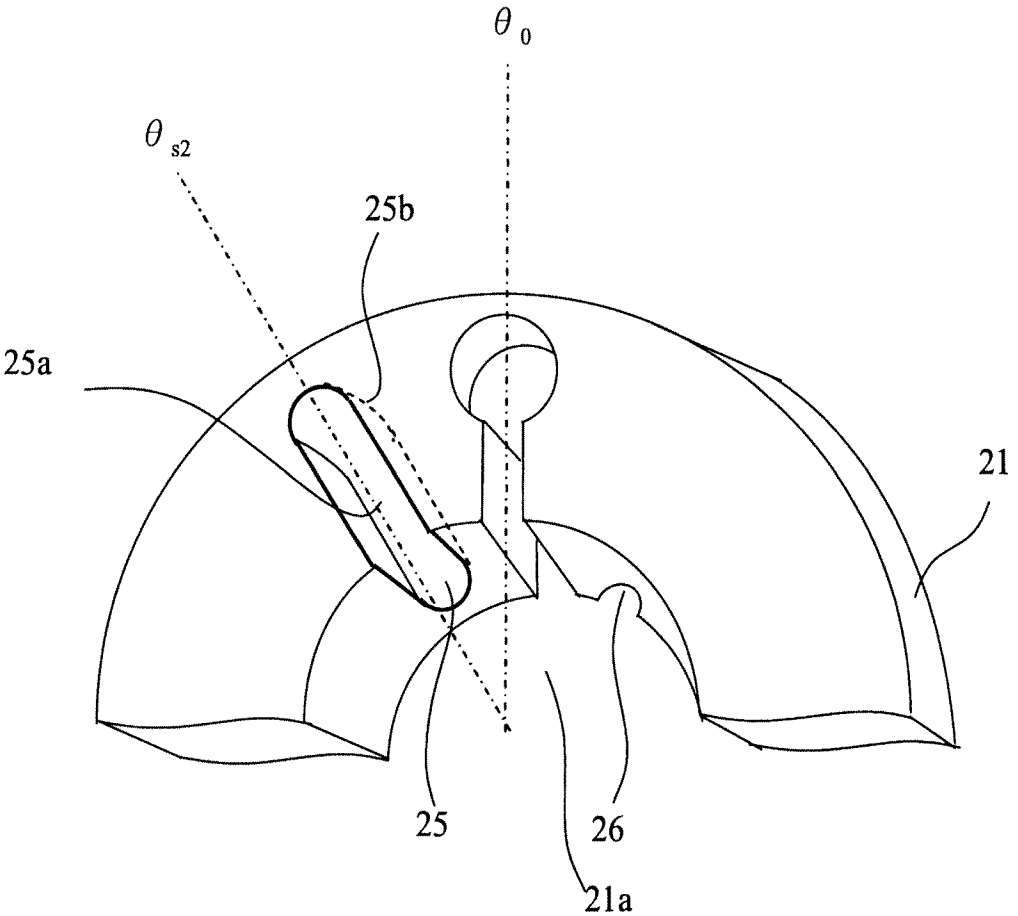
FIG. 7 is a perspective view near a cylinder suction flow path 25*a* of a cylinder 21 of a high-stage compression unit 20 of the two-stage compressor according to the first embodiment.

FIG. 7 is a perspective view near the cylinder suction flow path 25*a* of the cylinder 21 of the high-stage compression unit 20 of the two-stage compressor according to the first embodiment. In FIG. 7, a component that is actually invisible is indicated by dashed lines.

The cylinder suction flow path 25*a* of the high-stage compression unit 20 is formed at the phase $\theta_{s2}$. The cylinder suction flow path 25*a* is formed at one side of the cylinder 21. The cylinder suction flow path 25*a* has an end portion 25*b* which is connected with the interconnecting flow path 84. The end portion 25*b* is formed by ball-end milling so that the flow path smoothly curves with a predetermined curvature. This allows for reduction of a bend resistance at the bend portion 83 of the interconnecting flow path 84 leading to the cylinder suction flow path 25*a*. That is, an upward flow of the refrigerant in the interconnecting flow path 84 can be smoothly transformed into a horizontal flow in the cylinder suction flow path 25*a*.

As described above, in the two-stage compressor according to the first embodiment, the refrigerant is made to circulate in a fixed direction in the ring-shaped discharge muffler space 31 by providing the discharge port rear guide 41 and the injection port guide 47.

By circulating the refrigerant in a fixed direction in the ring-shaped discharge muffler space, pressure pulsations caused by a difference between the timing of discharging the refrigerant by the low-stage compression unit 10 and the timing of drawing in the refrigerant by the high-stage compression unit 20 can be turned into rotational motion energy instead of pressure losses. As a result, occurrence of pressure pulsations can be prevented.

By inducing the refrigerant to circulate in a fixed direction in the ring-shaped discharge muffler space, the refrigerant is facilitated to flow orderly, so that pressure losses can be prevented.

In the two-stage compressor according to the first embodiment, the communication port flow guide 46 and so on smoothly transform a horizontal flow of the refrigerant from the discharge port 16 to the communication port 34 in the discharge muffler space 31 into an upward flow. Pressure losses occurring when the refrigerant flows into the communication port 34 from the low-stage discharge muffler space 31 can be reduced, so that compressor efficiency can be enhanced.

The phase of the communication port 34 is arranged to coincide with the phase of the cylinder suction port 25 of the high-stage compression unit 20. Therefore, when the communication port 34 and the cylinder suction flow path 25*a* are connected with the interconnecting flow path 84 formed as a rectilinear path, the length of the cylinder suction flow path 25*a* can be shortened. Thus, the length of the narrow flow path from the communication port 34 to the cylinder suction port 25 can be shortened. As a result, pressure losses at the interconnecting flow path 84 can be reduced, so that the compressor efficiency can be enhanced.

The flow path is arranged to bend smoothly at the connection point of the cylinder suction flow path 25*a* and the interconnecting flow path 84. Therefore, an upward flow of the refrigerant in the interconnecting flow path 84 can be smoothly transformed into a horizontal flow in the cylinder suction flow path 25*a*. As a result, pressure losses occurring when the refrigerant flows from the interconnecting flow path 84 into the cylinder suction flow path 25*a* can be reduced, so that the compressor efficiency can be enhanced.

Figure 8:
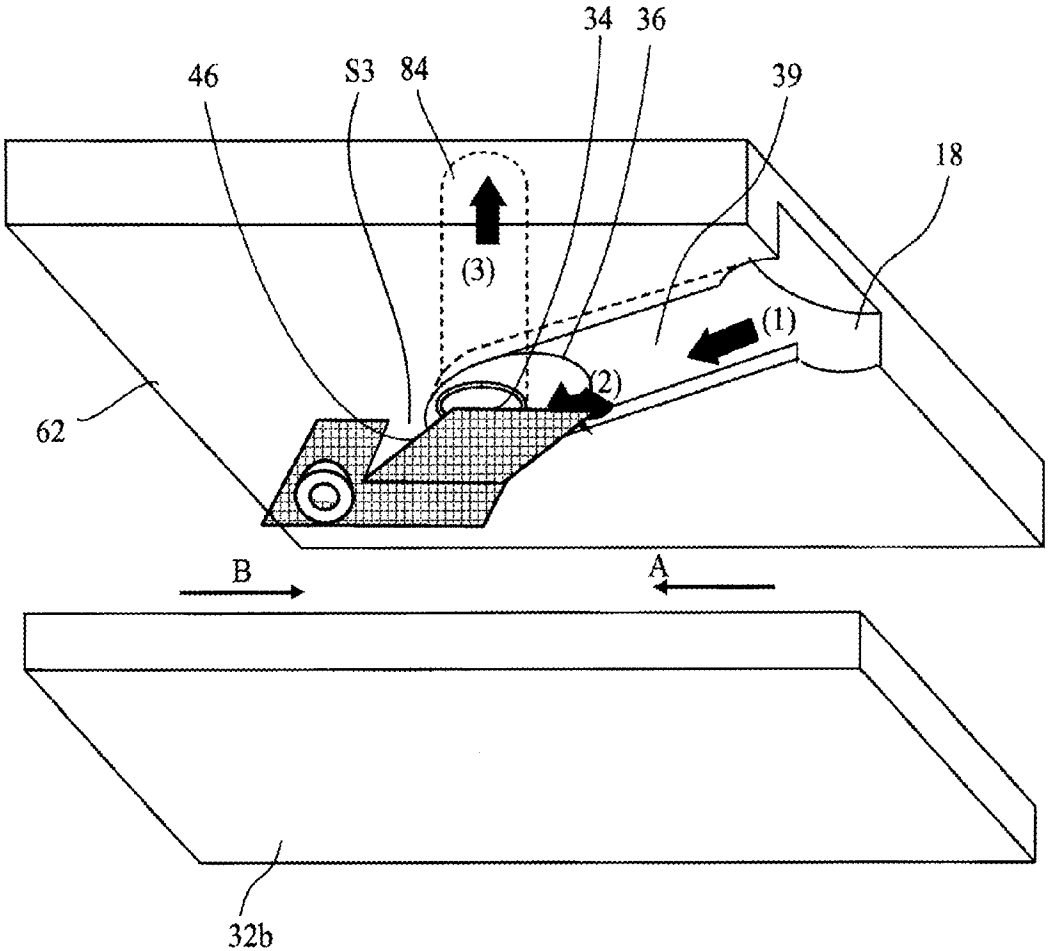
FIG. 8 is a diagram illustrating another example of the communication port flow guide 46 according to the first embodiment.

FIG. 8 is a diagram illustrating another example of the communication port flow guide 46 according to the first embodiment. In FIG. 8, a component that is actually invisible is indicated by dashed lines.

The communication port flow guide 46 is configured with a combination of flat faces formed by folding a flat plate. Specifically, the communication port flow guide 46 is fixed to the discharge-port-side wall 62 at a position outside of the communication port 34, and is provided so as to incline and protrude underneath the communication port 34. In particular, the communication port flow guide 46 is folded such that a tip portion 46*a* is inclined at a gentle angle. That is, the communication port flow guide 46 is folded such that the tip portion 46*a* is nearly parallel with the container outer wall 32*a* where the communication port 34 is formed.

When the communication port flow guide 46 is configured with a combination of flat faces formed by folding a flat plate as described above, the same effects can be obtained as the effects obtained by the communication port flow guide 46 shown in FIG. 6.

In FIG. 8, the interconnecting flow path 84 provided in the discharge-port-side wall 62 is formed so as to be substantially parallel with the drive shaft 6. When the interconnecting flow path 84 is thus formed, pressure losses occurring when a horizontal flow of the refrigerant from the discharge port 16 to the communication port 34 is transformed into an upward flow are increased compared to when the interconnecting flow path 84 is inclined. However, the length of the interconnecting flow path 84 can be shortened, so that pressure losses can be reduced.

Second Embodiment

Figure 9:
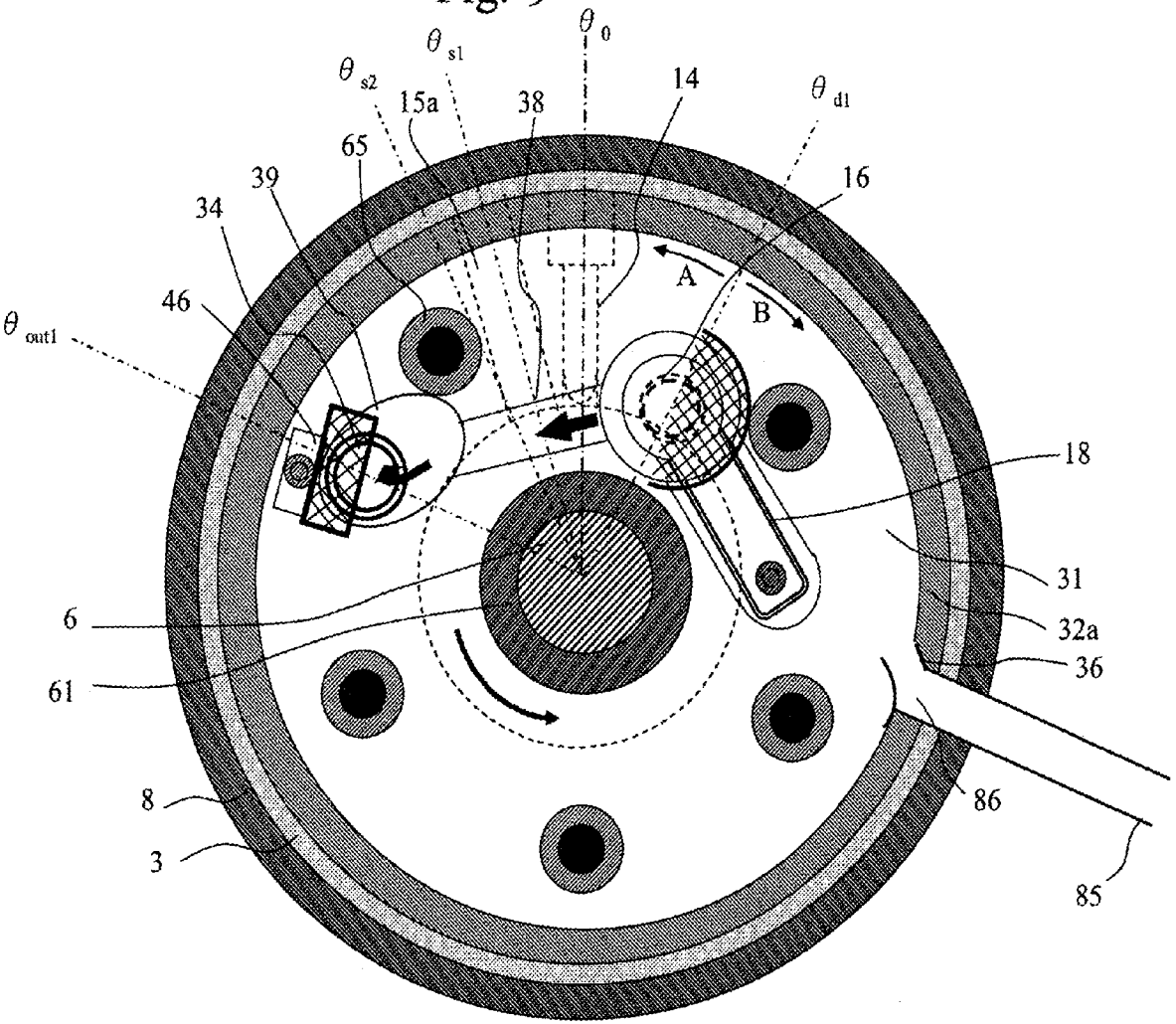
FIG. 9 is a diagram showing a portion corresponding to a cross-section taken along line A-A' of FIG. 1, and showing a low-stage discharge muffler space 31 of a two-stage compressor according to a second embodiment.

FIG. 9 is a diagram showing the low-stage discharge muffler space 31 of a two-stage compressor according to a second embodiment. FIG. 9 shows a portion corresponding to a cross-section taken along line A-A' of FIG. 1. In FIG. 9, a component that is actually invisible is indicated by dashed lines.

As to the low-stage discharge muffler space 31 shown in FIG. 9, only differences from the low-stage discharge muffler space 31 shown in FIG. 4 will be described.

A phase $\theta_{out1}$ at which the communication port 34 is positioned is shifted from the phase $\theta_{s2}$ at which the cylinder suction port 25 of the high-stage compression unit 20 is positioned.

Specifically, the communication port 34 is formed at the phase $\theta_{out1}$ removed from the phase $\theta_0$ of the position of the vane 14 around which the cylinder suction port 25, the discharge port 16, and so on are densely positioned. In the proximity of the phase $\theta_0$ of the position of the vane 14 around which the cylinder suction port 25, the discharge port 16, and so on are densely positioned, the cylinder suction flow path 15*a* of the low-stage compression unit 10, a bolt 65 and so on are also positioned. As a result, there is little space for forming the communication port 34 and the interconnecting flow path 84. For this reason, when the communication port 34 is formed in the proximity of the phase $\theta_0$ as described in the first embodiment, it is difficult to enlarge the open area of the communication port 34 and the flow path area of the interconnecting flow path 84. By forming the communication port 34 at the phase removed from the phase of the vane 14, the open area of the communication port 34 and the flow path area of the interconnecting flow path 84 can be enlarged.

However, when the communication port 34 is positioned at the phase shifted from the phase $\theta_{s2}$ at which the cylinder suction port 25 of the high-stage compression unit 20 is positioned, the communication port 34 is formed at a position removed from the discharge port 16. When the communication port 34 is formed at a position removed from the discharge port 16, it is difficult to directly connect the guide slot 39 of an oval shape with the discharge valve accommodating recessed portion 18. Accordingly, a connecting slot 38 is provided between the guide slot 39 and the discharge valve accommodating recessed portion 18. With this arrangement, the refrigerant discharged from the discharge port 16 can be guided to the communication port 34.

The cylinder suction flow path 25*a* of the high-stage compression unit 20 will be described.

Figure 10:
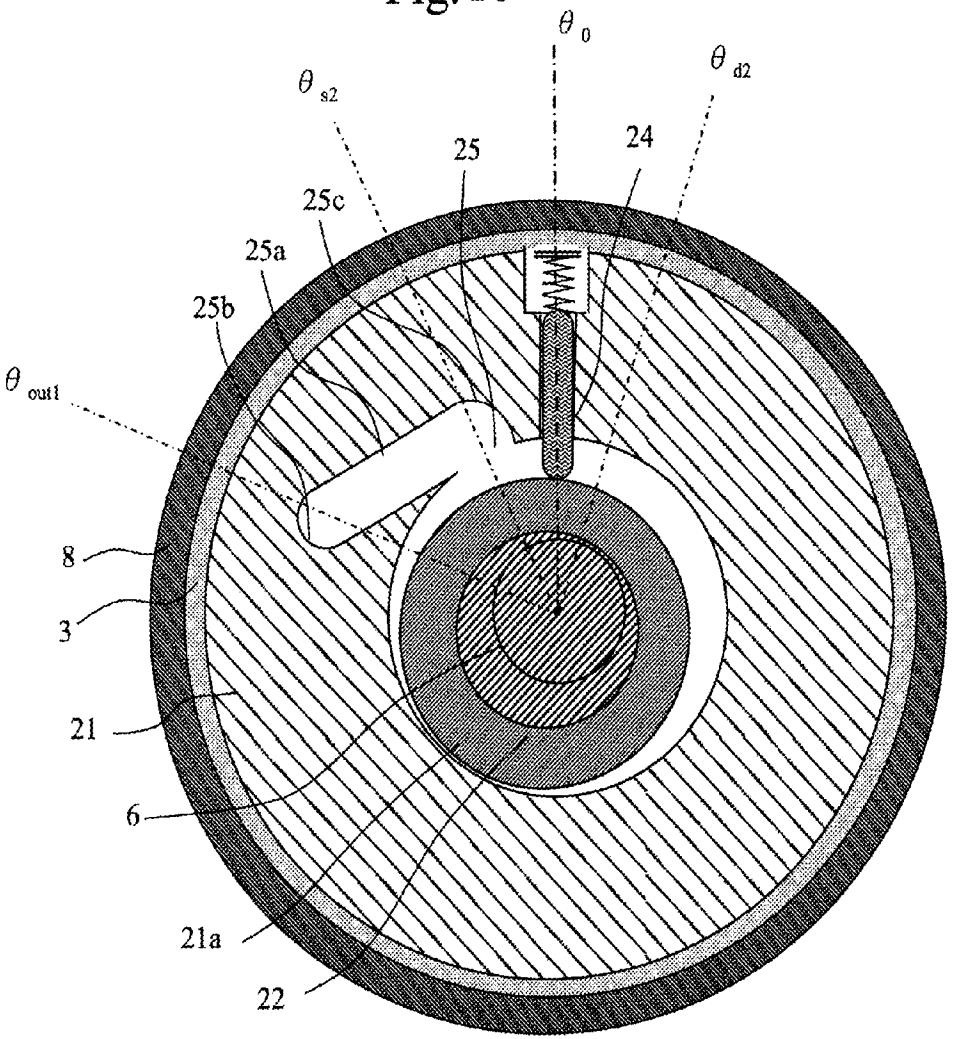
FIG. 10 is a diagram showing a portion corresponding to a cross-section taken along line C-C' of FIG. 1, and showing a high-stage compression unit 20 of the two-stage compressor according to the second embodiment.

FIG. 10 is a diagram showing the high-stage compression unit 20 of the two-stage compressor according to the second embodiment. FIG. 10 shows a portion corresponding to a cross-section taken along line C-C' of FIG. 1.

The cylinder suction port 25 of the high-stage compression unit 20 is formed at the phase $\theta_{s2}$. The communication port 34 is formed at the phase $\theta_{out1}$ different from the phase $\theta_{s2}$. Thus, the length of the cylinder suction flow path 25*a* according to the second embodiment is slightly longer compared to the cylinder suction flow path 25*a* according to the first embodiment.

The end portion 25*b* at which the interconnecting flow path 84 and the cylinder suction flow path 25*a* are connected is formed by ball-end milling such that the flow path has a predetermined curvature and the flow path curves smoothly. The cylinder suction flow path 25*a* is connected obliquely to the cylinder chamber 21*a*. Thus, in order to prevent pressure losses from occurring when the refrigerant flowing through the cylinder suction flow path 25*a* flows into the cylinder chamber 21*a*, an end portion 25*c* of the cylinder suction flow path 25*a* is also formed by ball-end milling.

As described above, in the two-stage compressor according to the second embodiment, the communication port 34 is formed at the phase removed from the phase of the vane 14 around which the cylinder suction port 25, the discharge port 16 and so on are densely positioned. With this arrangement, the open area of the communication port 34 and the flow path area of the interconnecting flow path 84 can be enlarged. As a result, pressure losses can be reduced, so that the compressor efficiency can be enhanced.

However, compared to the two-stage compressor according to the first embodiment, pressure losses are increased and the compressor efficiency is reduced because the length of the cylinder suction flow path 25*a* is slightly longer, and so on.

Third Embodiment

Figure 11:
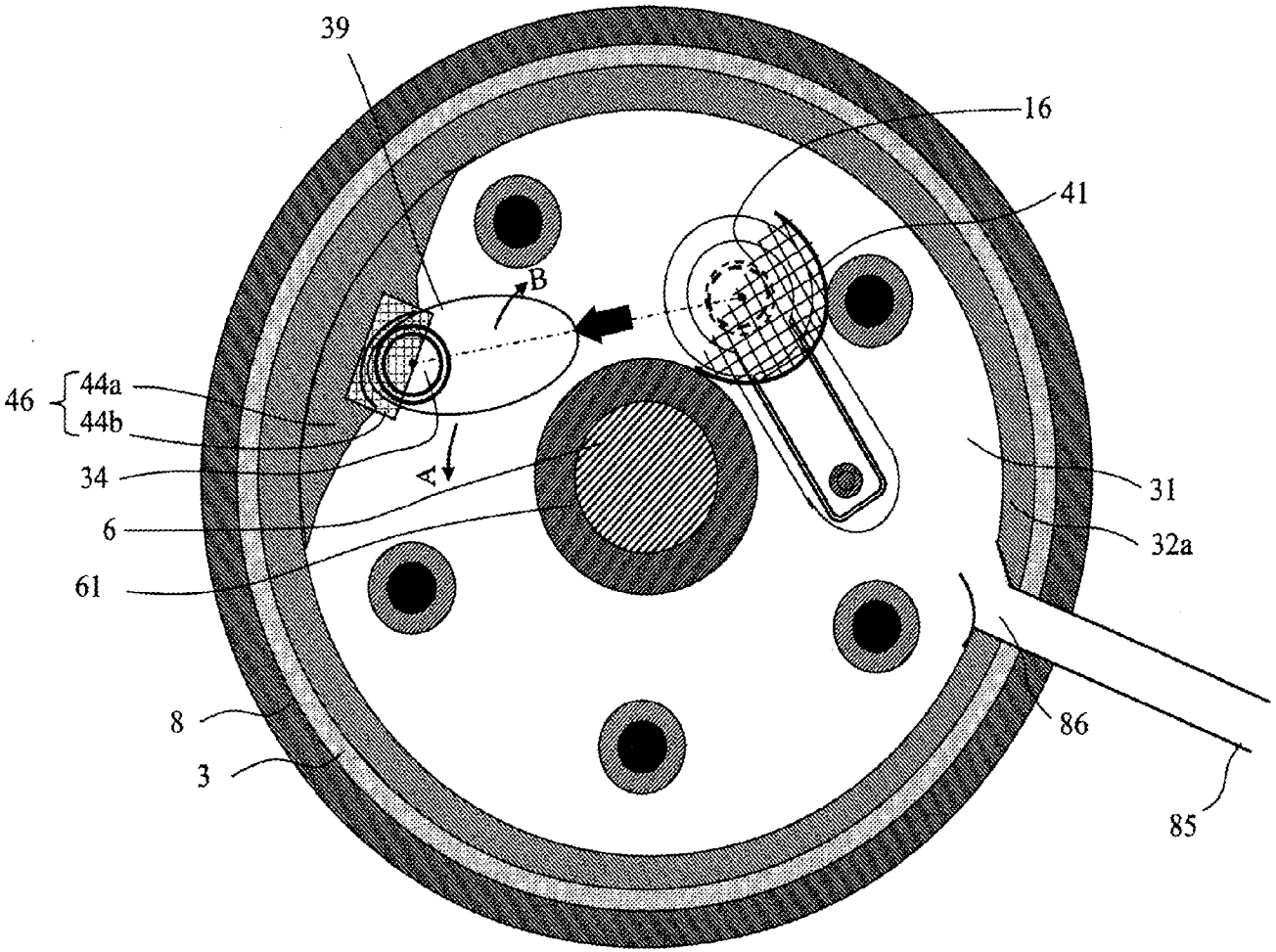
FIG. 11 is a diagram showing a portion corresponding to the cross-section taken along line A-A' of FIG. 1, and showing the low-stage discharge muffler space 31 of a two-stage compressor according to a third embodiment.

FIG. 11 is a diagram showing the low-stage discharge muffler space 31 of a two-stage compressor according to a third embodiment. FIG. 11 shows a portion corresponding to the cross-section taken along line A-A' of FIG. 1.

As to the low-stage discharge muffler space 31 shown in FIG. 11, only differences from the low-stage discharge muffler space 31 shown in FIG. 4 will be described.

The entire or part of the communication port flow guide 46 according to the third embodiment is molded integrally with the lower support member 60 or the container having the container wall 32*a*.

Figure 12:
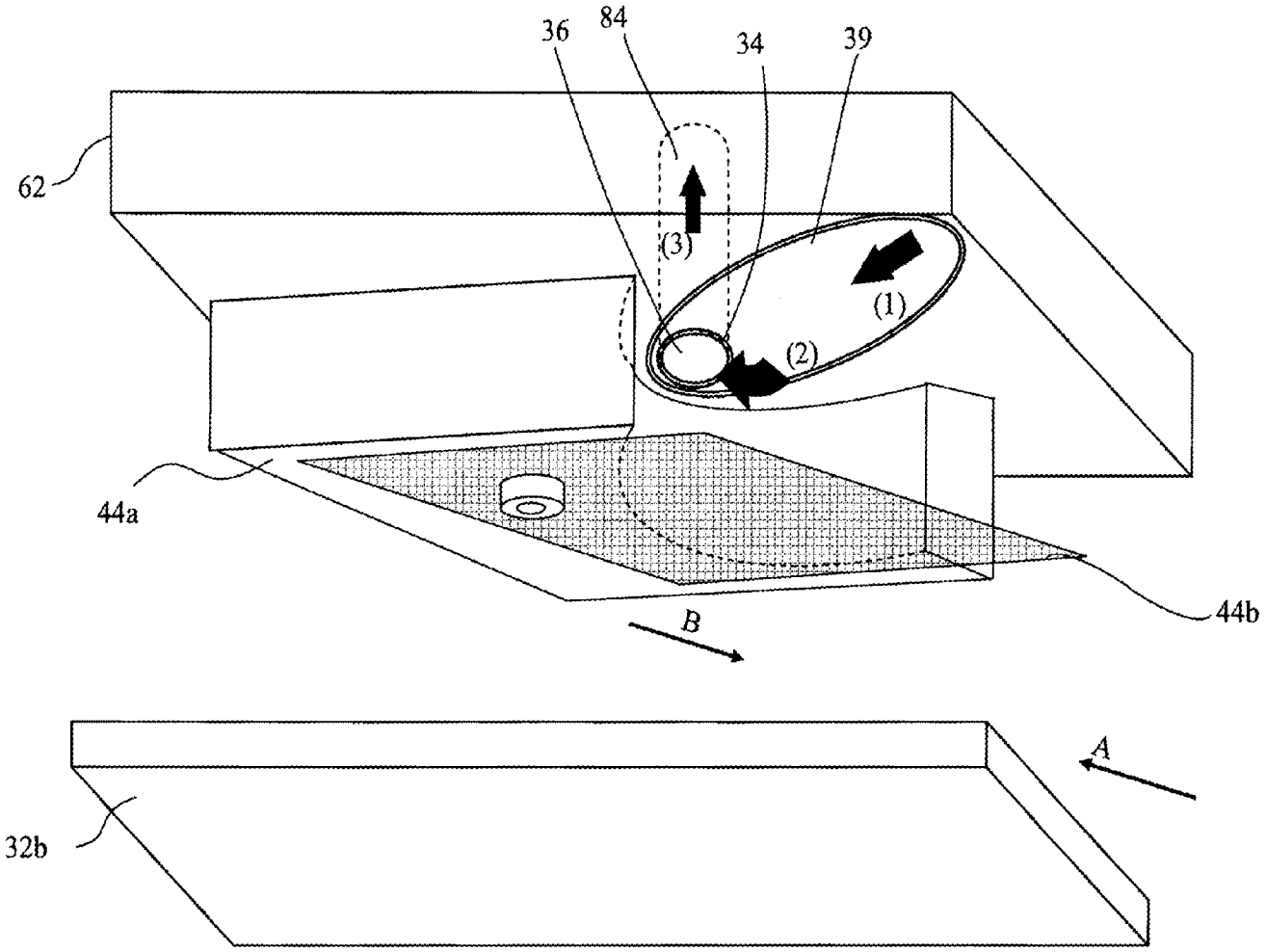
FIG. 12 is a diagram illustrating an example of the communication port flow guide 46 according to the third embodiment.

FIG. 12 is a diagram illustrating an example of the communication port flow guide 46 according to the third embodiment. In FIG. 12, a component that is actually invisible is indicated by dashed lines.

In the example shown in FIG. 12, a block 44*a* is formed by the discharge-port-side wall 62 of the lower support member 60 being protruded into the low-stage discharge muffler space 31 so as to cover the outside of the communication port 34. A metal plate 44*b* is attached to the block 44*a* such that the metal plate 44*b* covers the communication port 34 from underneath. The communication port flow guide 46 is formed by the block 44*a* and the metal plate 44*b*. The metal plate 44*b* is perforated metal, metallic mesh, or a metal plate with a large number of perforations.

Figure 13:
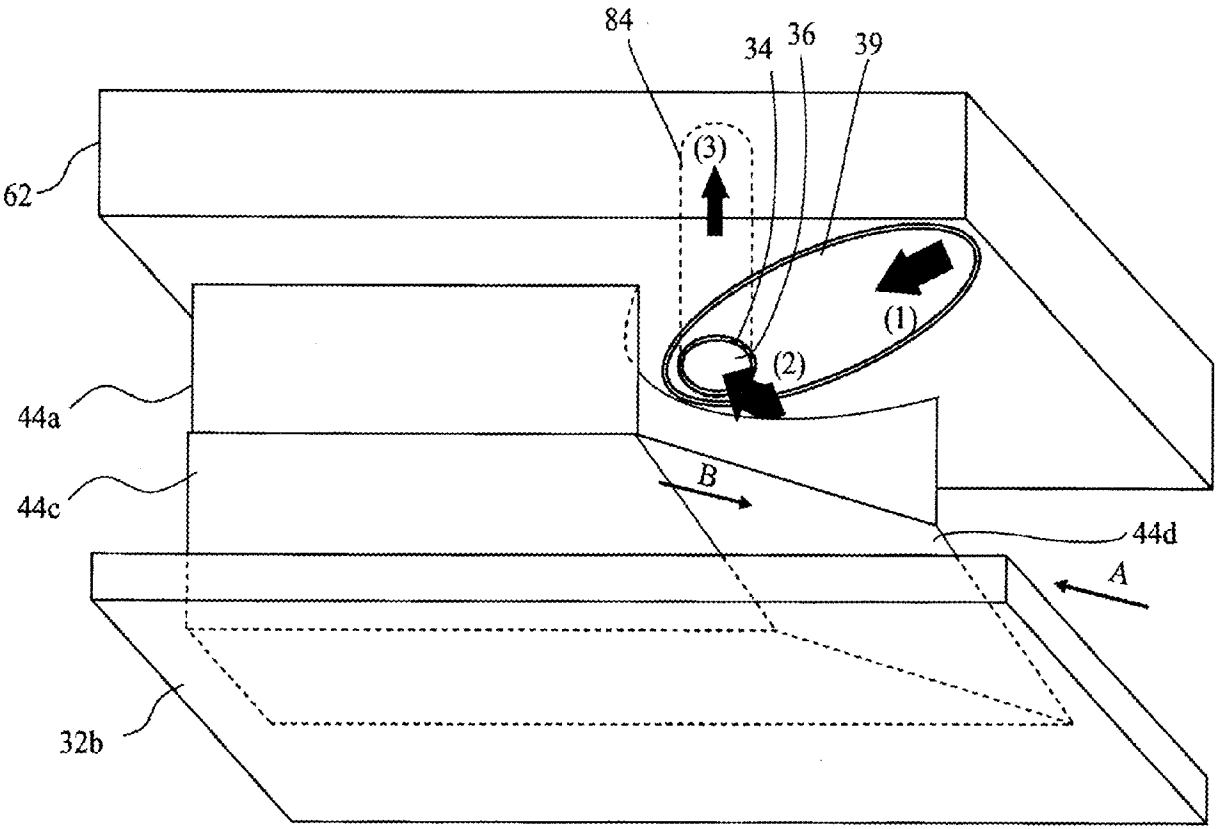
FIG. 13 is a diagram showing another example of the communication port flow guide 46 according to the third embodiment.

FIG. 13 is a diagram illustrating another example of the communication port flow guide 46 according to the third embodiment. In FIG. 13, a component that is actually invisible is indicated by dashed lines.

In the example shown in FIG. 13, the block 44*a* (first block) is formed by the discharge-port-side wall 62 of the lower support member 60 being protruded into the low-stage discharge muffler space 31 so as to cover the outside of the communication port 34, as in the example shown in FIG. 12.

In the example shown in FIG. 13, however, a sloped block 44*c* (second block) is formed by the container bottom lid 32*b* of the container having the container wall 32*a* being protruded toward the low-stage discharge muffler space 31 so as to cover the communication port 34 from underneath, instead of attaching the metal plate 44*b* to the block 44*a* so as to cover the communication port 34 from underneath. In particular, the sloped block 44*c* has a sloped face 44*d* gradually sloping from the outside of the communication port 34 away from the discharge-port-side wall 62 toward the axis 6*d*.

In the example shown in FIG. 12, only the block 44*a* is formed integrally with the lower support member 60. However, both the block 44*a* and the metal plate 44*b* may be formed integrally with the lower support member 60. The metal plate 44*b* may not be perforated if fabrication is difficult.

In the example shown in FIG. 13, the block 44*a* is formed integrally with the lower support member 60, and the sloped block 44*c* is formed integrally with the container having the container wall 32*a*. However, not only the sloped block 44*c* but also the block 44*a* may be formed integrally with the container having the container wall 32*a*.

As described above, with the two-stage compressor according to the third embodiment in which the communication port flow guide 46 is formed integrally with the lower support member 60, the compressor efficiency can be enhanced as with the two-stage compressor according to the first embodiment.

Fourth Embodiment

Figure 14:
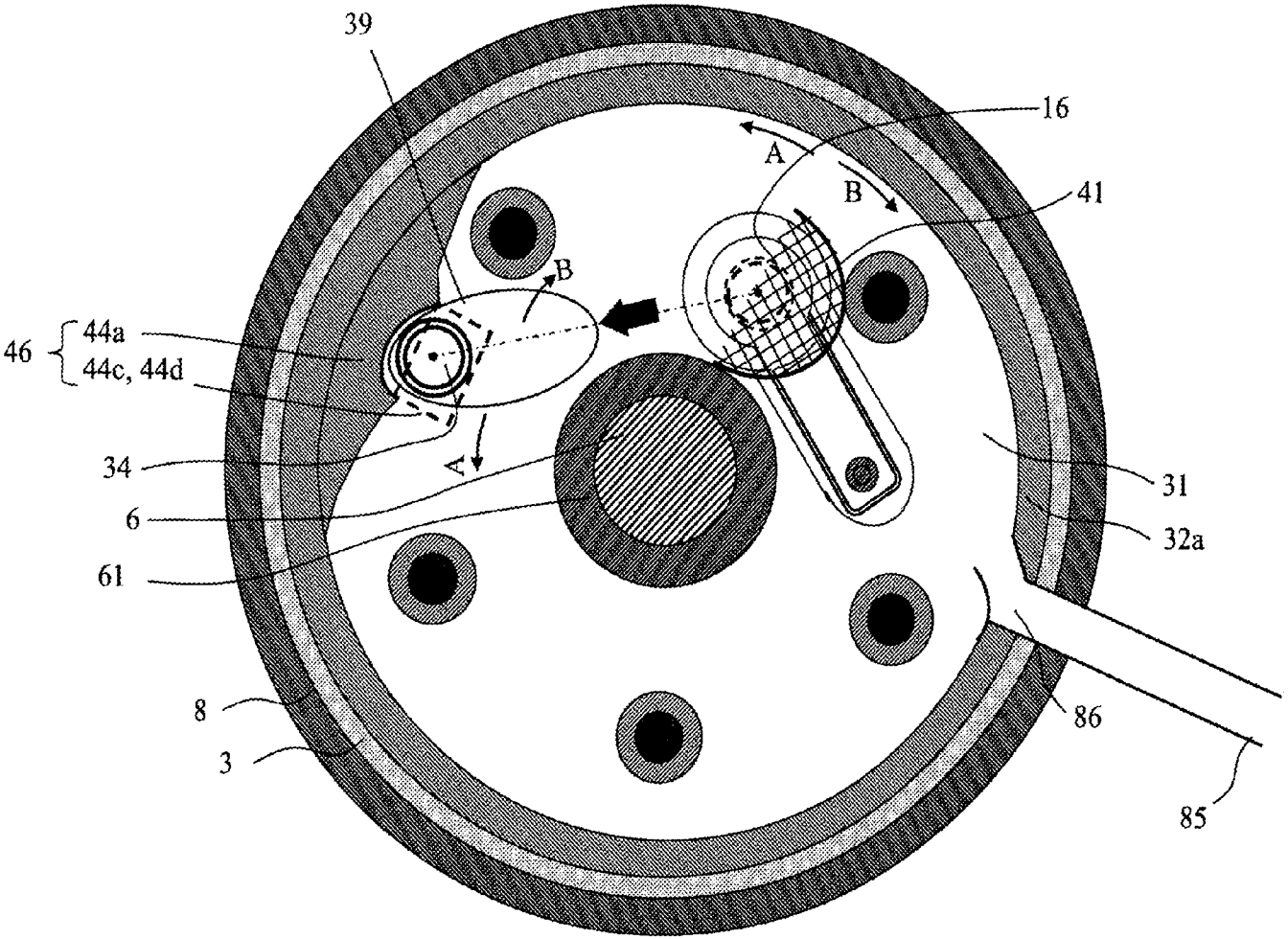
FIG. 14 is a diagram showing a portion corresponding to the cross-section taken along line A-A' of FIG. 1, and showing the low-stage discharge muffler space 31 of a two-stage compressor according to a fourth embodiment.

FIG. 14 is a diagram showing the low-stage discharge muffler space 31 of a two-stage compressor according to a fourth embodiment. FIG. 14 shows a portion corresponding to the cross-section taken along line A-A' of FIG. 1.

As to the low-stage discharge muffler space 31 shown in FIG. 14, only differences from the low-stage discharge muffler space 31 shown in FIG. 4 will be described.

The low-stage discharge muffler space 31 according to the fourth embodiment includes a curved flow path block 40 which is molded integrally with the lower support member 60, and in which the communication port 34 is formed.

Figure 15:
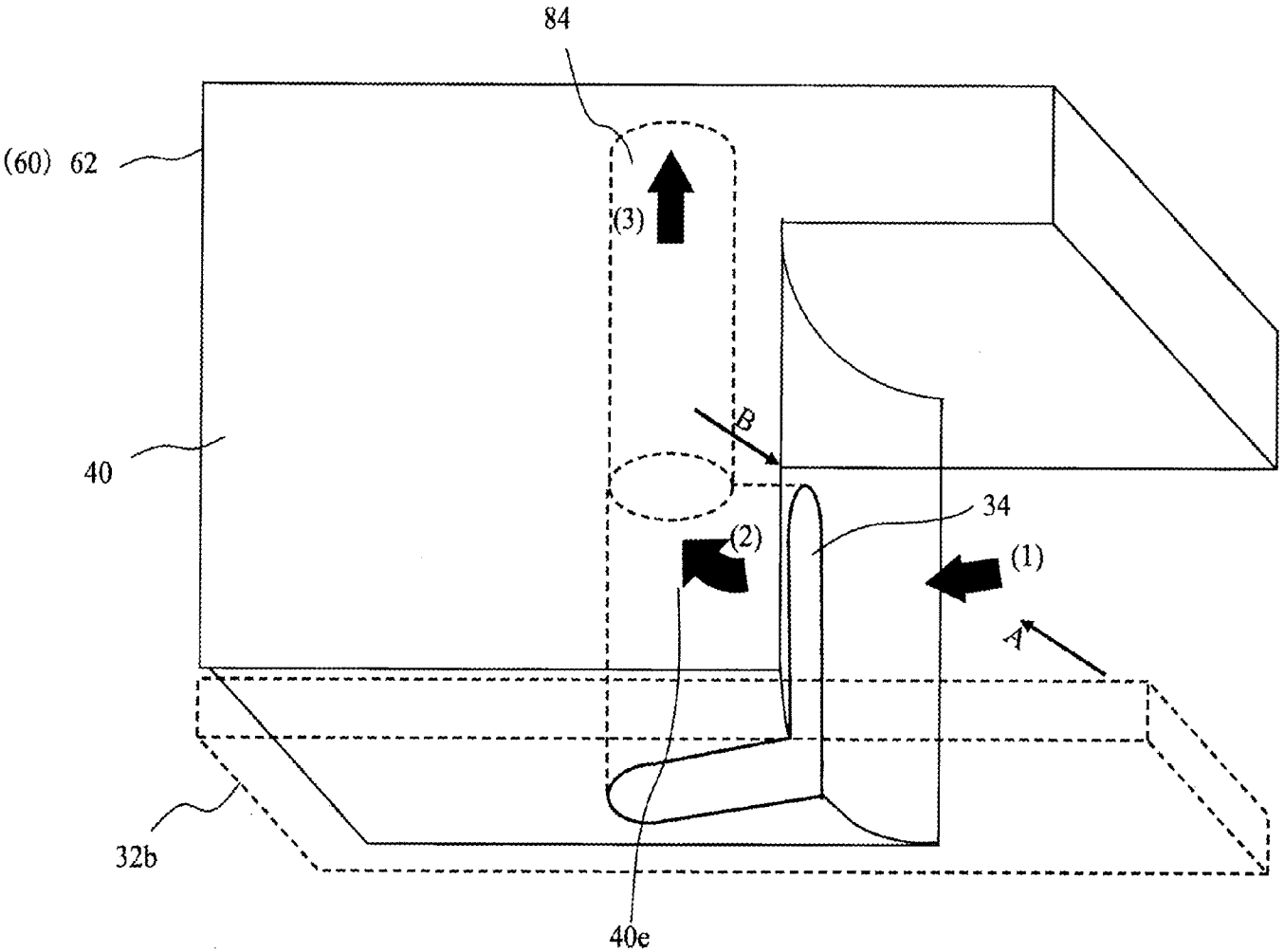
FIG. 15 is a diagram illustrating a curved flow path block 40 according to the fourth embodiment.

FIG. 15 is a diagram illustrating the curved flow path block 40 according to the fourth embodiment. In FIG. 15, a position of the container bottom lid 32*b* of the container having the container wall 32*a* is indicated by dashed lines. An internal configuration of the curved flow path block 40 that is actually invisible is indicated by dashed lines.

As shown in FIG. 15, the curved flow path block 40 is formed integrally with the lower support member 60. The curved flow path block 40 has formed therein an internal flow path 40*e* as a part of the interconnecting flow path 84. The curved flow path block 40 also has formed therein the communication port 34 facing the axis 6*d* and connected with the internal flow path 40*e*. That is, in the above embodiments, the communication port 34 is formed downwardly in the upper face of the low-stage discharge muffler space 31. In the fourth embodiment, the communication port 34 is formed laterally so as to face the axis 6*d*.

The communication port 34 is formed laterally so as to face the axis 6*d*, so that the refrigerant discharged from the discharge port 16 is facilitated to flow into the communication port 34.

The internal flow path 40*e* may be gently curved from the communication port 34 toward the interconnecting flow path 84. By forming the internal flow path 40*e* as described above, a horizontal flow of the refrigerant from the discharge port 16 to the communication port 34 can be smoothly transformed into an upward flow. Thus, pressure losses occurring when the refrigerant flows from the low-stage discharge muffler space 31 into the communication port 34 can be reduced, so that the compressor efficiency can be enhanced.

In the curved flow path block 40 integrally formed with the lower support member 60, the communication port 34 and a part of the interconnecting flow path 84 may be formed by end milling or the like.

As described above, with the two-stage compressor according to the fourth embodiment in which the curved flow path block 40 is provided in place of the communication port flow guide 46, the compressor efficiency can be enhanced as with the two-stage compressor according to the first embodiment.

Fifth Embodiment

Figure 16:
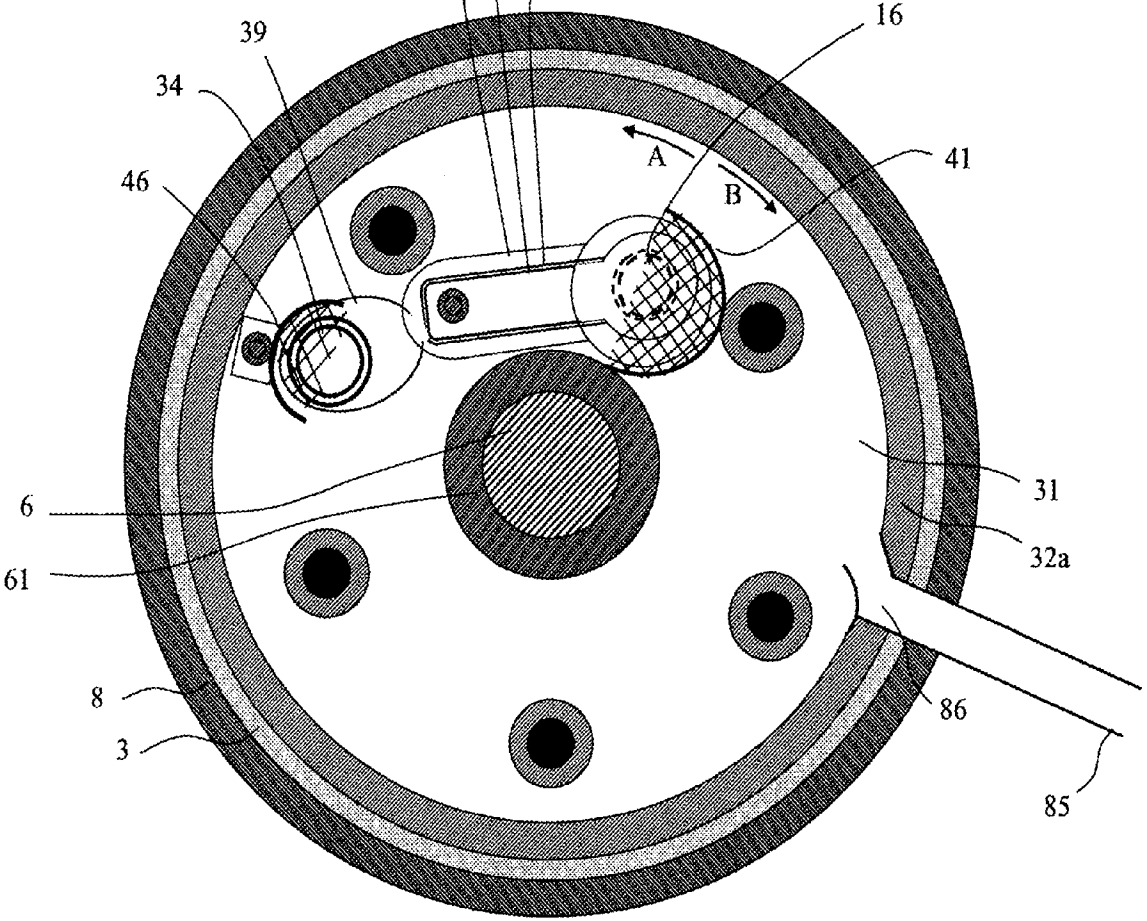
FIG. 16 is a diagram showing a portion corresponding to the cross-section taken along line A-A' of FIG. 1, and showing the low-stage discharge muffler space 31 of a low-stage compressor according to a fifth embodiment.

FIG. 16 is a diagram showing the low-stage discharge muffler space 31 of a two-stage compressor according to a fifth embodiment. FIG. 16 shows a portion corresponding to the cross-section taken along line A-A' of FIG. 1.

As to the low-stage discharge muffler space 31 shown in FIG. 16, only differences from the low-stage discharge muffler space 31 shown in FIG. 9 will be described.

In the fifth embodiment, the discharge valve accommodating recessed portion 18 is directed in an opposite direction to the direction of the second embodiment (see FIG. 9). In the second embodiment, the discharge valve accommodating recessed portion 18 is formed mainly at the flow path in the reverse direction (direction B of FIG. 9) from the discharge port 16 to the communication port 34. In the fifth embodiment, the discharge valve accommodating recessed portion 18 is mainly formed at the flow path in the forward direction (direction A of FIG. 16) from the discharge port 16 to the communication port 34.

As shown in FIG. 9, in the second embodiment, the guide slot 39 is not directly connected with the slot of the discharge valve accommodating recessed portion 18. In the fifth embodiment, however, the discharge valve accommodating recessed portion 18 is formed at the flow path in the forward direction from the discharge port 16 to the communication port 34, so that the slot of the discharge valve accommodating recessed portion 18 is positioned near the communication port 34. Thus, the guide slot 39 can be readily connected with the slot of the discharge valve accommodating recessed portion 18.

As described above, with the two-stage compressor according to the fifth embodiment in which the discharge valve accommodating recessed portion 18 is directed differently, the compressor efficiency can be enhanced as with the two-stage compressor according to the first embodiment.

Sixth Embodiment

Figure 17:
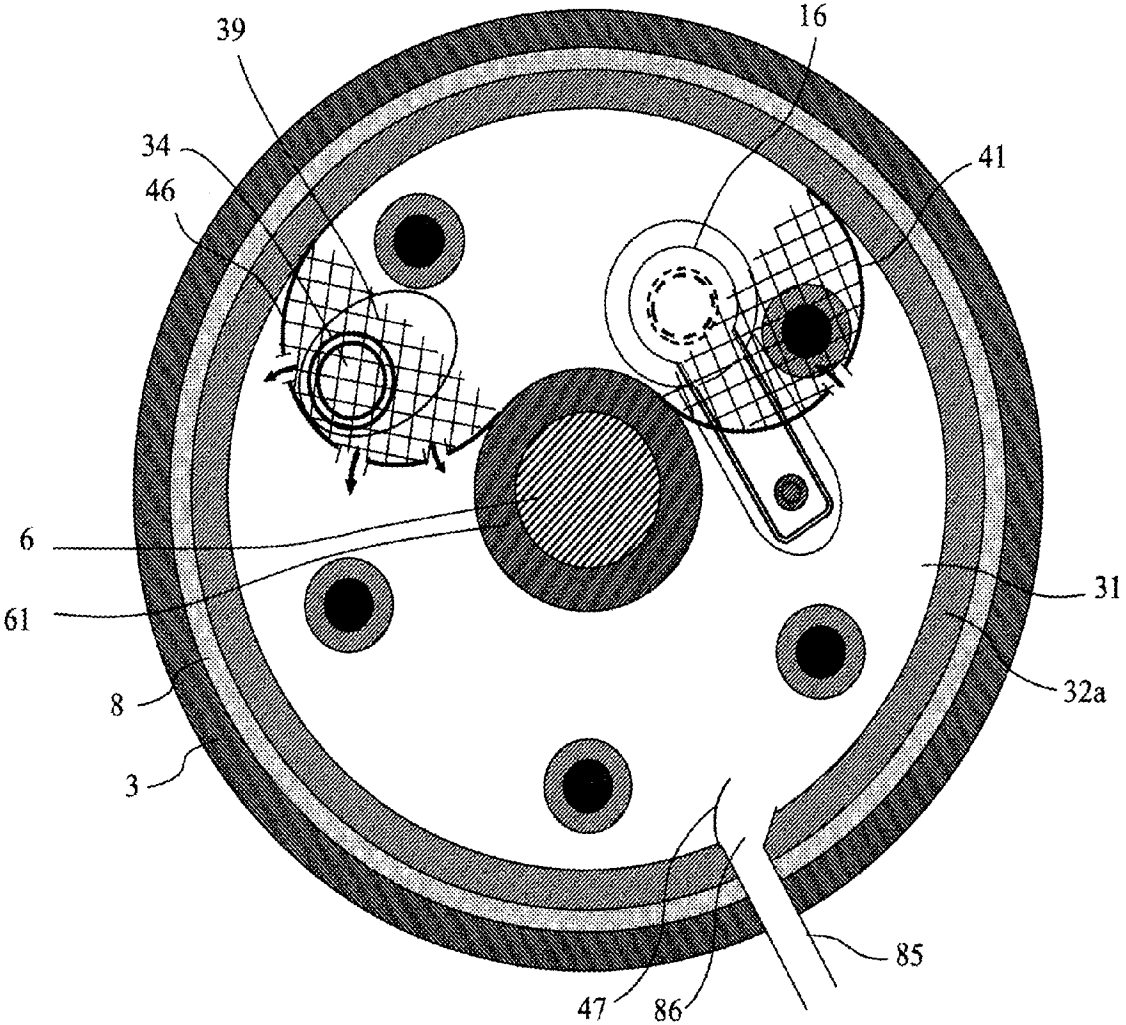
FIG. 17 is a diagram showing a portion corresponding to the cross-section taken along line A-A' of FIG. 1, and showing the low-stage discharge muffler space 31 of a two-stage compressor according to a sixth embodiment.

FIG. 17 is a diagram showing the low-stage discharge muffler space 31 of a two-stage compressor according to a sixth embodiment. FIG. 17 shows a portion corresponding to the cross-section taken along line A-A' of FIG. 1.

As to the low-stage discharge muffler space 31 shown in FIG. 17, only differences from the low-stage discharge muffler space 31 shown in FIG. 4 will be described.

The discharge port rear guide 41 is provided so as to partition the entire flow path, and has a smoothly curved face covering the discharge port 16 from the side of the flow path in the reverse direction from the discharge port 16 to the communication port 34. Likewise, the communication port flow guide 46 is provided so as to partition the entire flow path, and has a smoothly curved face covering the communication port 34 from the side of the flow path in the reverse direction from the discharge port 16 to the communication port 34.

The discharge port rear guide 41 and the communication port flow guide 46 include a plurality of perforations. An open rate of the communication port flow guide 46 is approximately three times as high as an open rate of the discharge port rear guide 41. That is, a flow path area of a portion where the communication port flow guide 46 is provided is approximately three times as large as a flow path area of a portion where the discharge port rear guide 41 is provided. Thus, a flow of the refrigerant discharged from the discharge port 16 is more strongly prevented by the discharge port rear guide 41 than by the communication port flow guide 46, so that the refrigerant flows in the forward direction.

The communication port flow guide 46 is provided so as to block the entire flow path, so that it is effective in guiding the refrigerant flowing near the communication port 34 to flow into the communication port 34. However, the refrigerant can be prevented from flowing in the forward direction, so that pressure losses are expected to increase when the refrigerant amount is high, such as during a high-speed operation. Thus, the open rate of the communication port flow guide 46 should preferably be 50% or higher.

With the two-stage compressor according to the sixth embodiment including the discharge port rear guide 41 and the communication port flow guide 46 as described above, the compressor efficiency can be enhanced as with the two-stage compressor according to the first embodiment.

Seventh Embodiment

Figure 18:
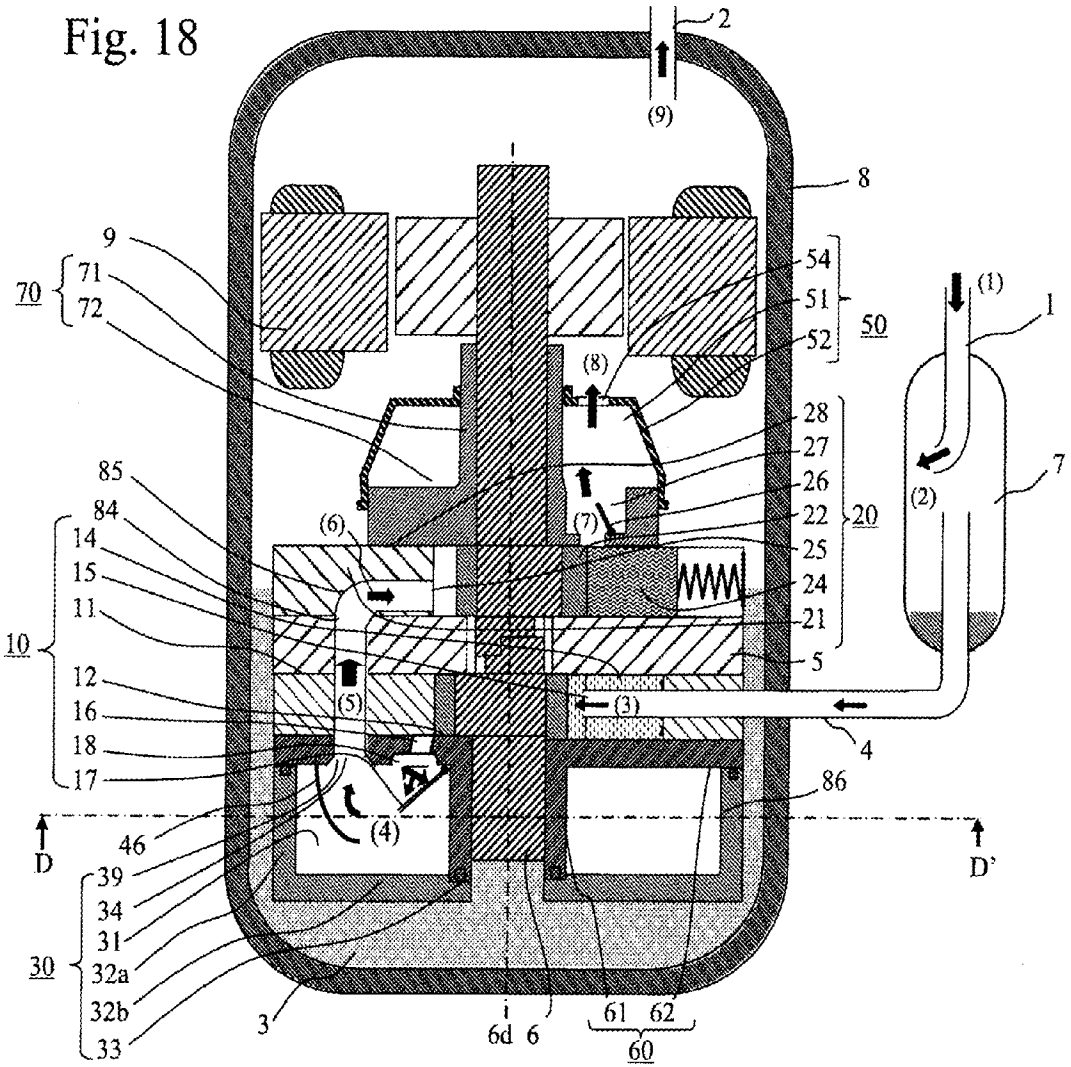
FIG. 18 is a cross-sectional view of an overall configuration of a two-stage compressor according to a seventh embodiment.

FIG. 18 is a sectional view of an overall configuration of a two-stage compressor according to a seventh embodiment.

Figure 19:
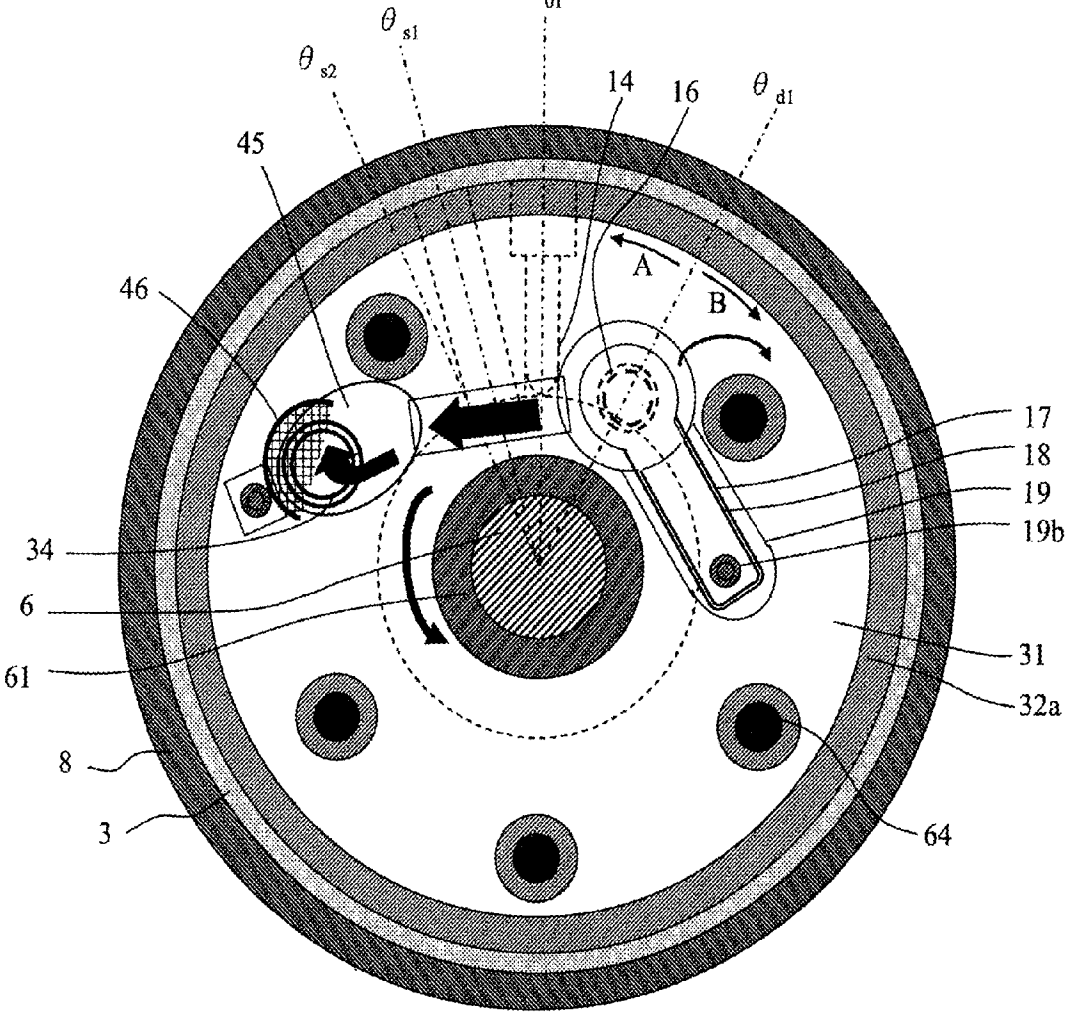
FIG. 19 is a cross-sectional view of the two-stage compressor according to the seventh embodiment taken along line D-D' of FIG. 18.

FIG. 19 is a cross-sectional view of the two-stage compressor according to the seventh embodiment taken along line D-D' of FIG. 18.

As to the two-stage compressor according to the seventh embodiment, only differences from the two-stage compressor according to the first embodiment will be described.

In the low-stage discharge muffler space 31 of the two-stage compressor according to the seventh embodiment, the discharge port rear guide 41 is not provided. The injection pipe 85 is not connected to the low-stage discharge muffler 30, and the injection port guide 47 is not provided in the low-stage discharge muffler space 31.

Thus, in the two-stage compressor according to the seventh embodiment, the refrigerant discharged from the discharge port 16 has less tendency to circulate in a fixed direction in the low-stage discharge muffler space 31 compared with the two-stage compressor according to the first embodiment. For this reason, in the two-stage compressor according to the seventh embodiment, pressure losses are increased compared with the two-stage compressor according to the first embodiment.

However, in the two-stage compressor according to the seventh embodiment, the communication port flow guide 46 is provided, so that a horizontal flow of the refrigerant from the discharge port 16 to the communication port 34 can be smoothly transformed into an upward flow, as in the two-stage compressor according to the first embodiment. Thus, compared with prior art two-stage compressors, pressure losses can be reduced to a certain degree.

In the above embodiments, descriptions have been directed to the two-stage compressor of a rolling piston type. However, any compression method may be used as long as a two-stage compressor has a muffler space interconnecting a high-stage compression unit and a low-stage compression unit. The same effects can also be obtained with various types of two-stage compressor such as, for example, a sliding piston type and a sliding vane type.

In the above embodiments, descriptions have been directed to the two-stage compressor of a high-pressure shell type in which the pressure in the closed shell 8 is equal to the pressure in the high-stage compression unit 20. However, the same effects can be obtained with a two-stage compressor of either an intermediate pressure shell type or a low pressure shell type.

In the above embodiments, descriptions have been directed to the two-stage compressor in which the low-stage compression unit 10 is positioned below the high-stage compression unit 20 such that the refrigerant is discharged downwardly into the low-stage discharge muffler space 31. However, the same effects can be obtained with different positionings of the low-stage compression unit 10, the high-stage compression unit 20, and the low-stage discharge muffler 30 and a different direction of rotation of the drive shaft 6.

For example, the same effects can be obtained with a two-stage compressor in which the low-stage compression unit 10 is positioned above the high-stage compression unit 20 such that the refrigerant is discharged upwardly into the low-stage discharge muffler space 31.

The same effects can also be obtained when a two-stage compressor normally placed longitudinally is placed laterally.

In the above embodiments, descriptions have been given assuming that the discharge valve mechanism for opening the discharge port 16 is of the reed valve type that opens and closes by the elasticity of the thin plate-like valve and the difference in pressure between the low-stage compression unit 10 and the low-stage discharge muffler space 31. However, other types of discharge valve mechanism may be used. What is required is a check valve that opens and closes the discharge port 16 by using the difference in pressure between the low-stage compression unit 10 and the low-stage discharge muffler space 31 such as, for example, a poppet valve type used in a ventilation valve of a four-stroke cycle engine.

Eighth Embodiment

In the first to seventh embodiments above, descriptions have been directed to the structures of the low-stage discharge muffler space 31 of the two-stage compressor in which two compression units are connected in series. In an eighth embodiment, descriptions will be directed to a structure of a lower discharge muffler of a single-stage twin compressor in which two compression units are connected in parallel.

In a prior art two-stage compressor, a difference between the timing of discharging a refrigerant by a low-stage compression unit and the timing of drawing in the refrigerant by a high-stage compression unit generates high pressure pulsations at an interconnecting portion. It is therefore extremely important to reduce intermediate pressure pulsation losses for enhancing the compressor efficiency.

On the other hand, in a prior art single-stage compressor, pressure pulsations as large as those generated in the interconnecting portion of the two-stage compressor are not generated. However, there is a lag between the phase of change in compression chamber volume and the phase of opening/closing of a valve. For this reason, pressure pulsations occur to no small degree in a discharge muffler. By reducing losses thus generated, the compressor efficiency can be enhanced.

In the eighth embodiment, a structure similar to the structures of the low-stage discharge muffler 30 of the two-stage compressor described in the first to seventh embodiments will be applied to a structure of a lower discharge muffler 130 of the single-stage twin compressor.

Figure 20:
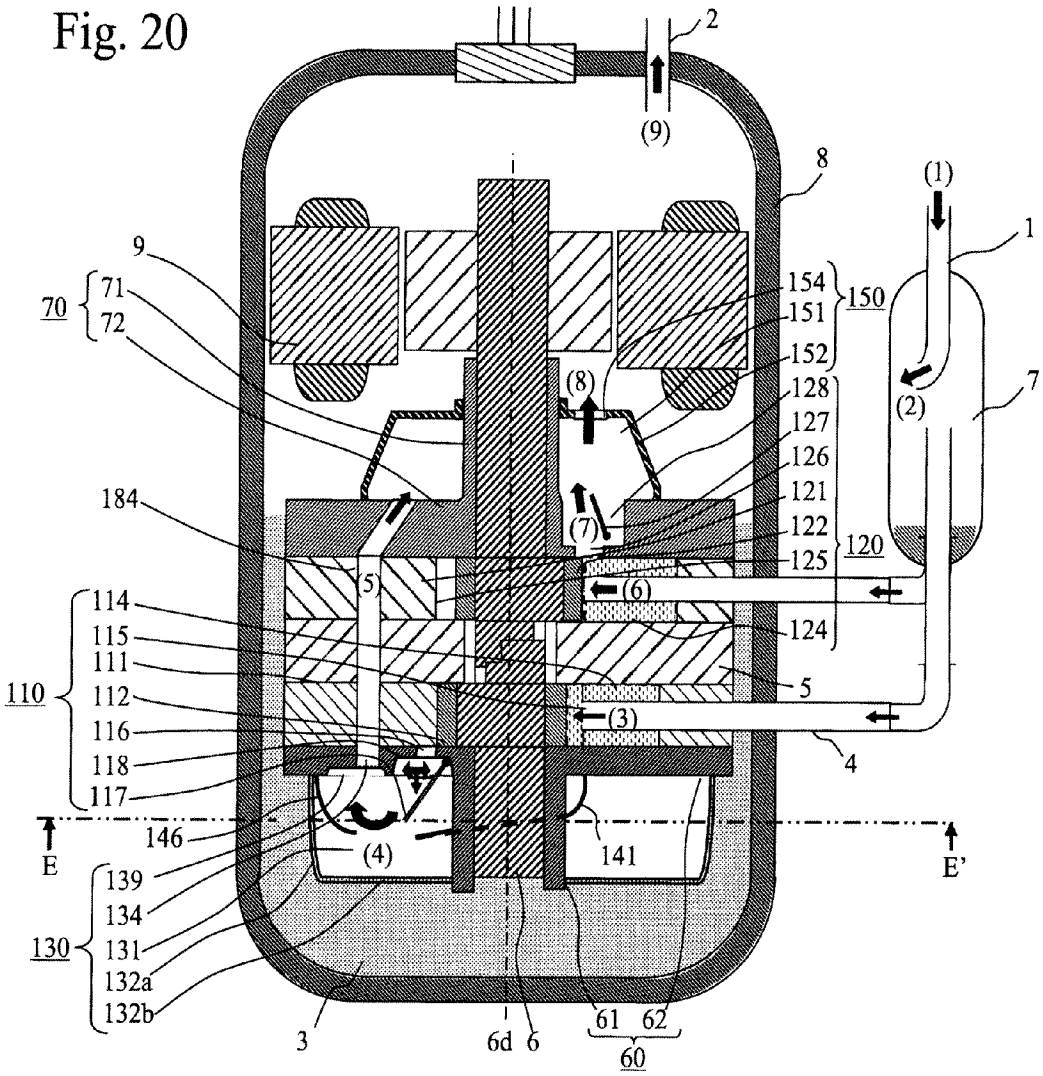
FIG. 20 is a cross-sectional view of an overall configuration of a single-stage twin compressor according to an eighth embodiment.

FIG. 20 is a cross-sectional view of an overall configuration of the single-stage twin compressor according to the eighth embodiment. As to the single-stage twin compressor shown in FIG. 20, only differences from the two-stage compressor shown in FIG. 1 will be described.

The single-stage twin compressor according to the eighth embodiment includes, in the closed shell 8, a lower compression unit 110, an upper compression unit 120, a lower discharge muffler 130, and an upper discharge muffler 150, in place of the low-stage compression unit 10, the high-stage compression unit 20, the low-stage discharge muffler 30, and the high-stage discharge muffler 50 included in the two-stage compressor according to the first embodiment.

The lower compression unit 110, the upper compression unit 120, the lower discharge muffler 130, and the upper discharge muffler 150 are constructed substantially similarly to the low-stage compression unit 10, the high-stage compression unit 20, the low-stage discharge muffler 30, and the high-stage discharge muffler 50. Thus, descriptions will be omitted. However, the pressure in a lower discharge muffler space 131 is approximately the same as the pressure in the closed shell 8, so that a sealing portion for sealing the lower discharge muffler is not required, unlike the low-stage discharge muffler 30 of the first embodiment.

A communication port 134 is formed in the discharge-port-side wall 62 such that the refrigerant that has flowed into the lower discharge muffler space 131 flows out from the communication port 134. A lower discharge flow path 184 (connecting flow path) connected with the communication port 134 is formed through the discharge-port-side wall 62, the lower compression unit 110, the intermediate partition plate 5, the upper compression unit 120, and the discharge-port-side wall 72. The lower discharge flow path 184 is a flow path that guides the refrigerant flowing out from the communication port 134 of the lower discharge muffler 130 to an upper discharge muffler space 151.

A flow of the refrigerant will be described.

First the refrigerant at a low pressure passes through the compressor suction pipe 1 ((1) of FIG. 20) and flows into the suction muffler 7 ((2) of FIG. 20). The refrigerant that has flowed into the suction muffler 7 is separated into the gas refrigerant and the liquid refrigerant in the suction muffler 7. At the suction muffler connecting pipe 4, the gas refrigerant branches into a suction muffler connecting pipe 4*a* and a suction muffler connecting pipe 4*b* to be drawn into the cylinder 111 of the lower compression unit 110 and the cylinder 121 of the upper compression unit 120 ((3) and (6) of FIG. 20).

The refrigerant drawn into the cylinder 111 of the lower compression unit 110 and compressed to a discharge pressure at the lower compression unit 110 is discharged from a discharge port 116 into the lower discharge muffler space 131 ((4) of FIG. 20). The refrigerant discharged into the lower discharge muffler space 131 passes through the communication port 134 and the lower discharge flow path 184 and is guided to the upper discharge muffler space 151 ((5) of FIG. 20).

The refrigerant drawn into the cylinder 121 of the upper compression unit 120 and compressed to a discharge pressure at the upper compression unit 120 is discharged from a discharge port 126 into the upper discharge muffler space 151 ((7) of FIG. 20).

The refrigerant guided from the lower discharge muffler space 131 to the upper discharge muffler space 151 ((5) of FIG. 20) is mixed with the refrigerant discharged from the discharge port 126 into the upper discharge muffler space 151 ((7) of FIG. 20). The mixed refrigerant is guided from the communication port 154 to a space between the motor unit 9 in the closed shell 8 ((8) of FIG. 20). Then, the refrigerant guided to the space between the motor unit 9 in the closed shell 8 passes through a clearance beside the motor unit 9 on top of the compression unit, then passes through the compressor discharge pipe 2 fixed to the closed shell 8, and is discharged to the external refrigerant circuit ((9) of FIG. 20).

The lower discharge muffler space 131 and the upper discharge muffler space 151 are interconnected. However, there is a lag between the compression timing of the lower compression unit 110 and the compression timing of the upper compression unit 120, so that pressure pulsations occur. A backflow of the refrigerant from the upper discharge muffler space 151 to the lower discharge muffler space 131 may also occur.

The lower discharge muffler 130 will be described.

Figure 21:
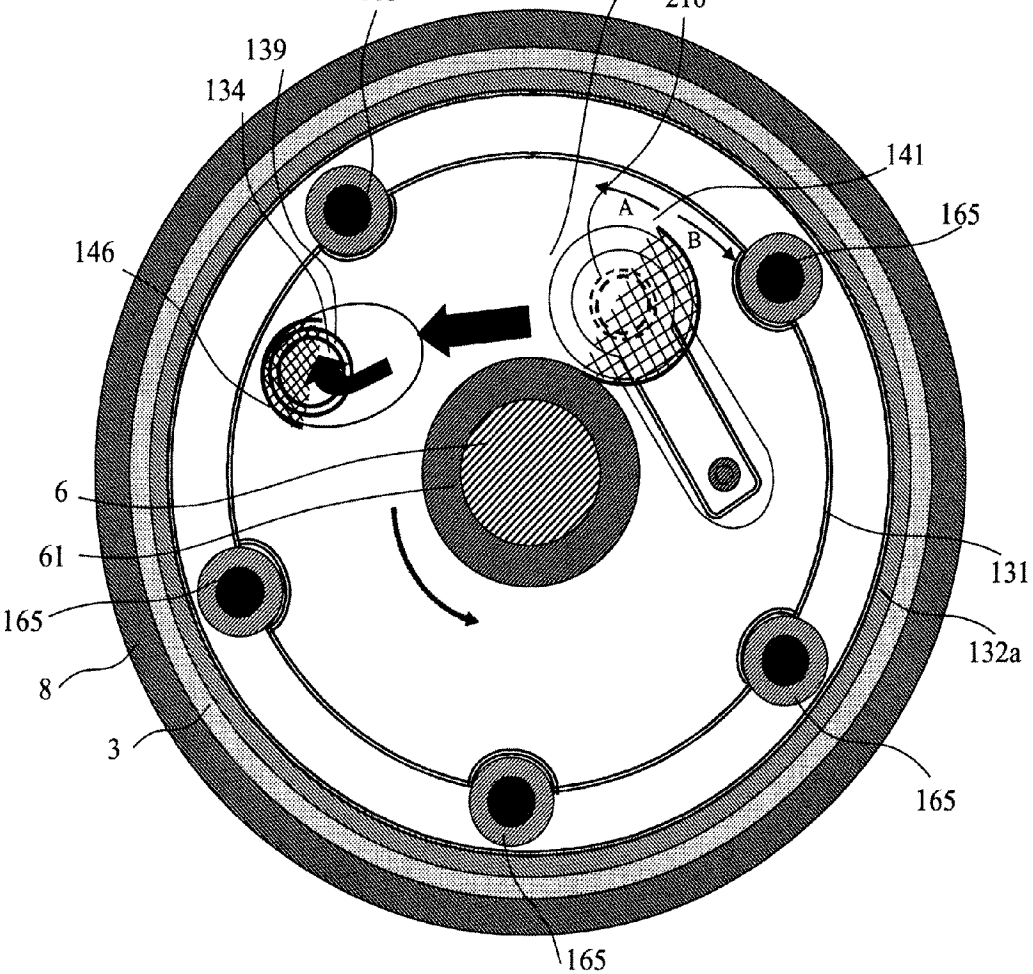
FIG. 21 is a cross-sectional view of the single-stage twin compressor according to the eighth embodiment taken along line E-E' of FIG. 20.

FIG. 21 is a cross-sectional view of the single-stage twin compressor according to the eighth embodiment taken along line E-E' of FIG. 20.

As shown in FIG. 21, the lower discharge muffler space 131 is formed in the shape of a ring (doughnut) around the drive shaft 6 such that, at a cross-section perpendicular to the axial direction of the drive shaft 6, an inner peripheral wall is formed by the lower bearing portion 61 and an outer peripheral wall is formed by a container outer wall 132*a*. That is, the lower discharge muffler space 131 is formed in the shape of a ring (loop) around the drive shaft 6.

A discharge muffler container 132 is fixed to the lower support member 60 with five pieces of bolts 165 evenly spaced apart. A fixing portion in which each bolt 165 is disposed is formed by making the discharge muffler container 132 protrude into the ring-shaped flow path.

In the lower discharge muffler space 131, a discharge port rear guide 141, a communication port flow guide 146, and a guide slot 139 are provided. The discharge port rear guide 141, the communication port flow guide 146, and the guide slot 139 are the same as the discharge port rear guide 41, the communication port flow guide 46, and the guide slot 39 described in the first embodiment.

The refrigerant compressed at the lower compression unit 110 is discharged from the discharge port 116 into the lower discharge muffler space 131 ((1) of FIG. 21). Guided by a force to draw the refrigerant into the communication port 134 and by the discharge port rear guide 141, the discharged refrigerant (i) circulates in the forward direction (direction A of FIG. 21) in the ring-shaped lower discharge muffler space 131 ((2) (4) of FIG. 21), and (ii) passes through the communication port 134 and the lower discharge flow path 184 and flows into the upper discharge muffler space 151 ((3) of FIG. 21). When the refrigerant flows into the communication port 134, a flow in a substantially horizontal direction (lateral direction of FIG. 20) is smoothly transformed into a flow in an axial upward direction (upward direction of FIG. 20) by the communication port flow guide 146. In addition, the guide slot 139 is formed around the communication port 134, so that the refrigerant is facilitated to flow into the communication port 134.

As described above, the compressor according to the eighth embodiment is capable of reducing an amplitude of pressure pulsations occurring in the refrigerant discharged from the compression unit and reducing pressure losses, as with the two-stage compressor according to the above embodiments. Thus, the compressor efficiency can be enhanced.

Ninth Embodiment

Figure 22:
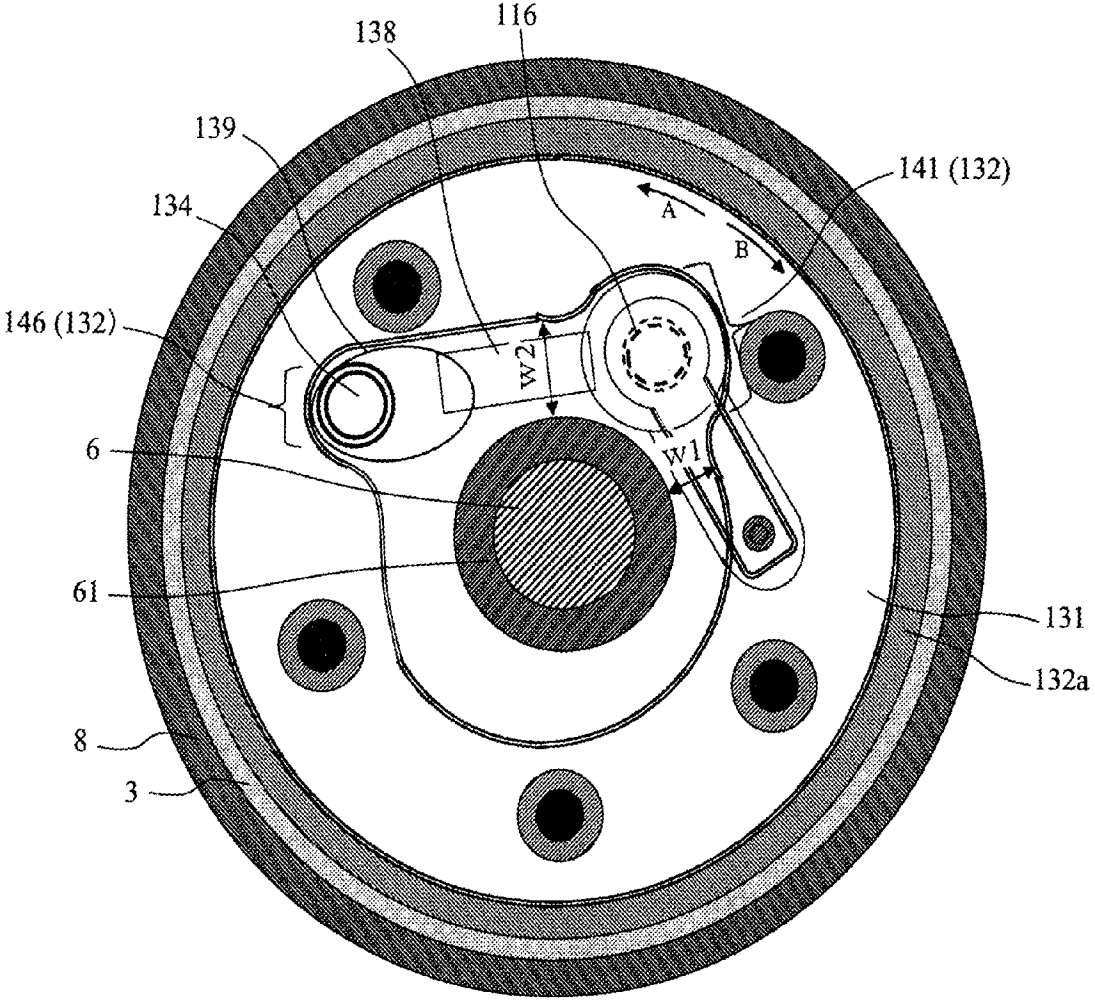
FIG. 22 is a diagram showing a portion corresponding to a cross-section taken along line E-E' of FIG. 20, and showing a lower discharge muffler space 131 of a single-stage twin compressor according to a ninth embodiment.

FIG. 22 is a diagram showing the lower discharge muffler space 131 of a single-stage twin compressor according to a ninth embodiment. FIG. 22 shows a portion corresponding to the cross-section taken along line E-E' of FIG. 20.

The discharge muffler container 132 shown in FIG. 21 is formed substantially symmetrically relative to the drive shaft 6 except for the bolt fixing portions. The discharge muffler container 132 shown in FIG. 22 is formed asymmetrically relative to the drive shaft 6.

In the discharge muffler container 132, a flow path width w1 (radial width of FIG. 22) at the rear side of the discharge port 116 is narrower than a minimum width w2 of a flow path in the forward direction out of two flow paths from the discharge port 116 to the communication port 134 in different directions around the shaft, i.e., the forward direction (direction A of FIG. 22) and the reverse direction (direction B of FIG. 22). That is, a flow path area at the rear side of the discharge port 116 is smaller than a minimum flow path area of the flow path in the forward direction from the discharge port 116 to the communication port 134.

Further, the discharge muffler container 132 is formed so as to cover the rear side of the discharge port 116, thereby functioning similarly to the discharge port rear guide 41 described in the first embodiment. The discharge muffler container 132 is also positioned so as to cover a predetermined area of the opening from outside of the communication port 134, thereby functioning similarly to the communication port flow guide 146 described in the eighth embodiment.

The flow path width w1 at the rear side of the discharge port 116 is narrower than the minimum width w2 of the flow path in the forward direction from the discharge port 116 to the communication port 134, so that the refrigerant discharged from the discharge port 116 is facilitated to flow in the forward direction (direction A of FIG. 22) rather than in the reverse direction (direction B of FIG. 22). In particular, the discharge muffler container 132 is formed so as to function similarly to the discharge port rear guide 41 described in the first embodiment, so that the refrigerant discharged from the discharge port 116 is facilitated to flow in the forward direction (direction A).

As described above, with the single-stage twin compressor according to the ninth embodiment, the amplitude of pressure pulsations occurring in the refrigerant discharged from the compression unit can be reduced and pressure losses can be reduced, as with the compressors according to the above embodiments. Thus, the compressor efficiency can be enhanced.

The two-stage compressor and single-stage twin compressor described in the above embodiments can also provide the effects described above with the use of HFC refrigerants (R410A, R22, R407, etc.), natural refrigerants such as HC refrigerants (isobutane, propane) and a CO2 refrigerant, and low-GWP refrigerants such as HFO1234yf.

In particular, the two-stage compressor and the single-stage twin compressor described in the above embodiments provide greater effects with refrigerants operating at a low pressure such as HC refrigerants (isobutane, propane), R22, and HFO1234yf.

In the eighth and ninth embodiments, descriptions have been directed to the structures of the lower discharge muffler space of the single-stage twin compressor. However, the compressor efficiency can be enhanced most effectively when a structure similar to the structures of the lower discharge muffler space described in the eighth and ninth embodiments is applied to the low-stage discharge muffler space of the two-stage compressor.

A structure similar to the structures of the discharge muffler space described in the first to seventh embodiments may also be applied to the lower discharge muffler space of the single-stage twin compressor.

Tenth Embodiment

In a tenth embodiment, a heat pump type heating and hot water system 200 will be described, as a usage example of the multi-stage compressor (two-stage compressor) described in the above embodiments.

Figure 23:
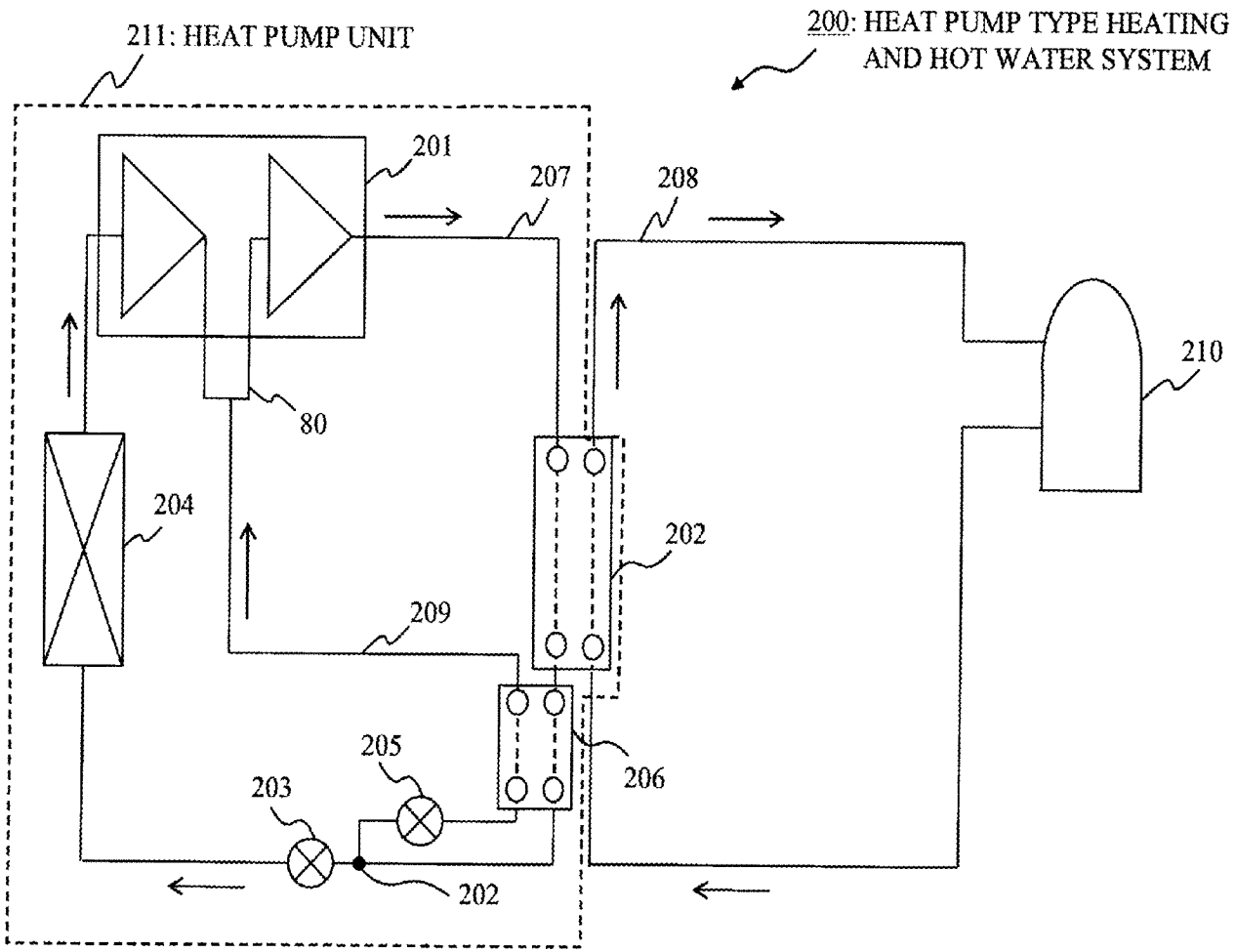
FIG. 23 is a schematic diagram showing a configuration of a heat pump type heating and hot water system 200 according to a tenth embodiment.

FIG. 23 is a schematic diagram showing a configuration of the heat pump type heating and hot water system 200 according to the tenth embodiment. The heat pump type heating and hot water system 200 includes a compressor 201, a first heat exchanger 202, a first expansion valve 203, a second heat exchanger 204, a second expansion valve 205, a third heat exchanger 206, a main refrigerant circuit 207, a water circuit 208, an injection circuit 209, and a water using device 220 for heating and hot water supply. The compressor 201 is the multi-stage compressor (two-stage compressor) described in the above embodiments.

A heat pump unit 211 (heat pump apparatus) is comprised of the main refrigerant circuit 207 in which the compressor 201, the first heat exchanger 202, the first expansion valve 203, and the second heat exchanger 204 are connected sequentially, and the injection circuit 209 in which part of the refrigerant is diverted at a branch point 212 between the first heat exchanger 202 and the first expansion valve 203 such that the refrigerant flows through the second expansion valve 205 and the third heat exchanger 206 and returns to an interconnecting portion 80 of the compressor 201. The heat pump unit 211 operates as an efficient economizer cycle.

At the first heat exchanger 202, the refrigerant compressed by the compressor 201 is heat-exchanged with a liquid (water herein) flowing through the water circuit 208. The heat exchange at the first exchanger 202 cools the refrigerant and heats the water. The first expansion valve 203 expands the refrigerant heat-exchanged at the first heat exchanger 202. At the second heat exchanger 204, the refrigerant expanded according to control of the first expansion valve 203 is heat-exchanged with air. The heat exchange at the second heat exchanger 204 heats the refrigerant and cools the air. Then, the heated refrigerant is drawn into the compressor 201.

Further, part of the refrigerant heat-exchanged at the first heat exchanger 202 is diverted at the branch point 212 and is expanded at the second expansion valve 205. At the third heat exchanger 206, the refrigerant expanded according to control of the second expansion valve 205 is internally heat-exchanged with the refrigerant cooled at the first heat exchanger 202, and the refrigerant is then injected into the interconnecting portion 80 of the compressor 201. In this way, the heat pump unit 211 includes an economizer means for enhancing cooling and heating capabilities by a pressure-reducing effect of the refrigerant flowing through the injection circuit 209.

Referring now to the water circuit 208, as described above, the water is heated by the heat exchange at the first heat exchanger 202, and the heated water flows to the water using device 220 for heating and hot water supply and is used for hot water supply and heating. The water for hot water supply may not be the water heat-exchanged at the first heat exchanger 202. That is, the water flowing through the water circuit 208 may be further heat-exchanged with the water for hot water supply at a water heater or the like.

A refrigerant compressor according to this invention provides excellent compressor efficiency by itself. Further, by incorporating the refrigerant compressor into the heat pump type heating and hot water system 200 described in this embodiment and configuring an economizer cycle, a configuration suited for enhancing efficiency can be realized.

The foregoing description assumed the use of the two-stage compressor described in the first to seventh embodiments. However, a vapor compression type refrigerant cycle of a heat pump type heating and hot water system or the like may be configured by using the single-stage twin compressor described in the eighth to ninth embodiments.

The foregoing description concerned the heat pump type heating and hot water system (ATW (air to water) system) that heats water by the refrigerant compressed by the refrigerant compressor described in the above embodiments. However, the embodiments are not limited to this arrangement. It is also possible to form a vapor compression type refrigeration cycle in which a gas such as air is heated or cooled by the refrigerant compressed by the refrigerant compressor described in the above embodiments. That is, a refrigeration air conditioning system may be constructed with the refrigerant compressor described in the above embodiments. A refrigeration air conditioning system using the refrigerant compressor according to this invention is advantageous in enhancing efficiency.

REFERENCE SIGNS LIST

1: compressor suction pipe, 2: compressor discharge pipe, 3: lubricating oil storage unit, 4: suction muffler connecting pipe, 5: intermediate partition plate, 6: drive shaft, 7: suction muffler, 8: closed shell, 9: motor unit, 10: low-stage compression unit, 20: high-stage compression unit, 11, 21: cylinders, 11*a*, 21*a*: cylinder chambers, 12, 22: rolling pistons, 14, 24: vanes, 14*a*, 24*a*: vane slots, 15, 25: cylinder suction ports, 15*a*, 25*a*: cylinder suction flow paths, 16, 26: discharge ports, 17, 27, discharge valves, 18, 28: discharge valve accommodating recessed portions, 19: stopper, 19*b*: bolt, 30: low-stage discharge muffler, 31: low-stage discharge muffler space, 32*a*: container outer wall, 32*b*: container bottom lid, 33: sealing portion, 34: communication port, 36: tapered portion, 38: connecting slot, 39: guide slot, 40: curved flow path block, 40*e*: internal flow path, 41: discharge port rear guide, 46: communication port flow guide, 47: injection port guide, 50: high-stage discharge muffler, 51: high-stage discharge muffler space, 52: container, 54: communication port, 60: lower support member, 61: lower bearing portion, 62: discharge-port-side wall, 65: bolt, 70: upper support member, 71: upper bearing portion, 72: discharge-port-side wall, 80: interconnecting portion, 83: bend portion, 84: interconnecting flow path, 85: injection pipe, 86: injection port, 110: lower compression unit, 120: upper compression unit, 111, 121: cylinders, 111*a*, 121*a*: cylinder chambers, 112, 121: rolling pistons, 14, 24: vanes, 115, 125: cylinder suction ports, 115*a*, 125*a*: cylinder suction flow paths, 116, 126: discharge ports, 117, 127: discharge valves, 118, 128: discharge valve accommodating recessed portions, 119: stopper, 130: lower discharge muffler, 131: lower discharge muffler space, 132: container, 132*a*: container outer wall, 132*b*: container bottom lid, 134: communication port, 136: tapered portion, 138: connecting slot, 139: guide slot, 141: discharge port rear guide, 146: communication port flow guide, 150: upper discharge muffler, 151: upper discharge muffler space, 152: container, 154: communication port, 160: lower support member, 161: lower bearing portion, 162: discharge-port-side wall, 165: bolt, 170: upper support member, 171: upper bearing portion, 172: discharge-port-side wall, 184: lower discharge flow path, 200: heat pump type heating and hot water system, 201: compressor, 202: first heat exchanger, 203: first expansion valve, 204: second heat exchanger, 205: second expansion valve, 206: third heat exchanger, 207: main refrigerant circuit, 208: water circuit, 209: injection circuit, 210: water using device for heating and hot water supply, 211: heat pump unit, 212: branch point

The invention claimed is:

1. A refrigerant compressor configured by stacking a plurality of compression units and an intermediate partition plate in a direction of a drive shaft, the plurality of compression units being driven by rotation of the drive shaft passing through a center portion, each of the plurality of compression units drawing a refrigerant into a cylinder chamber and compressing the refrigerant in the cylinder chamber, and the intermediate partition plate being positioned between the cylinder chamber of one of the plurality of compression units and the cylinder chamber of another one of the plurality of compression units, the refrigerant compressor comprising:

a discharge muffler that defines, as a ring-shaped space around the drive shaft, a discharge muffler space including a discharge port through which the refrigerant compressed at a predetermined compression unit of the plurality of compression units is discharged from the cylinder chamber of that compression unit, and a communication port through which the refrigerant discharged through the discharge port flows out to a different space;

a connecting flow path that passes through the intermediate partition plate in the direction of the drive shaft, and guides the refrigerant from the discharge muffler space through the communication port to the different space;

a communication port flow guide that is formed to protrude into the ring-shaped space to cover a predetermined area of an opening portion of the communication port in the discharge muffler space; and a discharge port rear guide that is positioned closer to the discharge port than to the communication port in a flow path in a reverse direction out of two flow paths from the discharge port to the communication port in different directions around the drive shaft in the ring-shaped discharge muffler space, the discharge port rear guide preventing the refrigerant discharged through the discharge port from flowing in the reverse direction, wherein the discharge port rear guide prevents the refrigerant from flowing in the reverse direction, thereby causing the refrigerant to circulate in a forward direction in the ring-shaped discharge muffler space, and wherein the communication port flow guide and the discharge port rear guide are configured such that a pressure loss caused by the communication port flow guide and the discharge port rear guide in a circulation flow of the refrigerant around the drive shaft in the ring-shaped discharge muffler space is smaller when the refrigerant circulates in the forward direction than in the reverse direction.

2. The refrigerant compressor of claim 1, wherein the communication port flow guide and the discharge port rear guide are configured such that a fluid resistance caused by the communication port flow guide in the circulation flow of the refrigerant in the forward direction is smaller than a fluid resistance caused by the discharge port rear guide in the circulation flow of the refrigerant in the reverse direction.

3. The refrigerant compressor of claim 1, wherein the communication port flow guide is configured such that the fluid resistance caused by the communication port flow guide in the circulation flow of the refrigerant in the forward direction is smaller than or equal to a fluid resistance caused by the communication port flow guide in the circulation flow of the refrigerant in the reverse direction.

4. The refrigerant compressor of claim 1, wherein at a cross-section of the ring-shaped discharge muffler space perpendicular to the direction of the drive shaft, an outer shape of the communication port flow guide is any one of a chord of airfoil shape, a circular arc of circular shape, and an elliptical arc of elliptical shape, and an opening portion connected to the communication port is formed in a concave side of the communication port flow guide.

5. The refrigerant compressor of claim 1, wherein the communication port flow guide has formed therein an opening portion directed to a shaft core and positioned so as to be substantially parallel with a circulation flow around the drive shaft.

6. The refrigerant compressor of claim 1, wherein the communication port flow guide protrudes from a compression-unit-side face where the communication port is formed toward the discharge muffler space, and an opposed face of the communication port flow guide opposed to the compression-unit-side face is gradually inclined toward the shaft core away from the communication port.

7. The refrigerant compressor of claim 6, wherein the communication port flow guide is formed such that the opposed face gradually curves toward the shaft core away from the communication port, gradually approaching a parallel position with the compression-unit-side face.

8. The refrigerant compressor of claim 7, wherein the communication port flow guide is a flat plate that gradually curves toward the shaft core away from the communication port, gradually approaching a parallel position with the compression-unit-side face, the flat plate having a plurality of perforations.

9. The refrigerant compressor of claim 1, wherein the communication port flow guide is formed integrally with a member defining the discharge muffler space.

10. The refrigerant compressor of claim 1, wherein in the discharge muffler space, a valve accommodating slot for accommodating a discharge valve that controls opening and closing of the discharge port is provided around the discharge port, and a guide slot connected with the valve accommodating slot is provided around the communication port.

11. The refrigerant compressor of claim 1, comprising:

two of the compression units being driven by rotation of the drive shaft passing through the center portion, each of the compression units drawing the refrigerant into the cylinder chamber and compressing the refrigerant in the cylinder chamber, wherein a phase of drawing in and compressing the refrigerant in the cylinder chamber of one of the compression units is shifted by 180 degrees relative to a phase of drawing in and compressing the refrigerant in the cylinder chamber of another one of the compression units.

12. The refrigerant compressor of claim 1, wherein the plurality of compression units are configured such that two compression units which are a low-stage compression unit and a high-stage compression unit are connected in series, and the intermediate partition plate is positioned between the cylinder constituting one of the compression units and the cylinder constituting another one of the compression units in a stack in the direction of the drive shaft, wherein the discharge muffler defines the discharge muffler space into which is discharged the refrigerant compressed by the low-stage compression unit, at an opposite side from the high-stage compression unit in the direction of the drive shaft relative to the low-stage compression unit, and wherein the high-stage compression unit draws in the refrigerant compressed by the low-stage compression unit from the discharge muffler space into the cylinder chamber and further compresses the refrigerant, the high-stage compression unit drawing in the refrigerant through the connecting flow path that passes through the cylinder constituting the low-stage compressor unit and through the intermediate partition plate in the direction of the drive shaft.

13. The refrigerant compressor of claim 12, wherein the cylinder constituting the high-stage compression unit further includes a suction flow path that extends in a direction perpendicular to the direction of the drive shaft and connects with the connecting flow path, and the refrigerant discharged into the discharge muffler space is drawn into the cylinder chamber of the high-stage compression unit through the connecting flow path and the suction flow path, and the refrigerant is further compressed in the cylinder chamber, and wherein a connection portion between the connecting flow path and the suction flow path curves with a predetermined curvature.

14. The refrigerant compressor of claim 1, further comprising a discharge valve that opens and closes the discharge port, wherein the communication port flow guide is located in the discharge muffler space.

15. The refrigerant compressor of claim 1, wherein the communication port flow guide is perforated.

16. A heat pump apparatus comprising a refrigerant circuit in which a refrigerant compressor, a first heat exchanger, an expansion mechanism, and a second heat exchanger are sequentially connected by pipes, wherein the refrigerant compressor is configured by stacking a plurality of compression units and an intermediate partition plate in a direction of a drive shaft, the plurality of compression units being driven by rotation of the drive shaft passing through a center portion, each of the plurality of compression units drawing a refrigerant into a cylinder chamber and compressing the refrigerant in the cylinder chamber, and the intermediate partition plate being positioned between the cylinder chamber of one of the plurality of compression units and the cylinder chamber of another one of the plurality of compression units, and wherein the refrigerant compressor includes a discharge muffler that defines, as a ring-shaped space around the drive shaft, a discharge muffler space including a discharge port through which the refrigerant compressed at a predetermined compression unit of the plurality of compression units is discharged from the cylinder chamber of that compression unit, and a communication port through which the refrigerant discharged through the discharge port flows out to a different space;

a connecting flow path that passes through the intermediate partition plate in the direction of the drive shaft, and guides the refrigerant from the discharge muffler space through the communication port to the different space;

a communication port flow guide that is formed to protrude into the ring-shaped space to cover a predetermined area of an opening portion of the communication port in the discharge muffler space; and a discharge port rear guide that is positioned closer to the discharge port than to the communication port in a flow path in a reverse direction out of two flow paths from the discharge port to the communication port in a forward direction and the reverse direction around the drive shaft in the ring-shaped discharge muffler space, wherein the discharge port rear guide prevents the refrigerant from flowing in the reverse direction, thereby causing the refrigerant to circulate in the forward direction in the ring-shaped discharge muffler space, wherein the communication port flow guide and the discharge port rear guide are configured such that a pressure loss caused by the communication port flow guide and the discharge port rear guide in a circulation flow of the refrigerant around the drive shaft in the ring-shaped discharge muffler space is smaller when the refrigerant circulates in the forward direction than in the reverse direction.

* * * * *